US011591195B2

(12) United States Patent
Heath et al.

(10) Patent No.: US 11,591,195 B2
(45) Date of Patent: Feb. 28, 2023

(54) AUTOMOTIVE LIFT AND SWING ARM RESTRAINT SYSTEM FOR AUTOMOTIVE LIFT

(71) Applicant: AUTOMOTIVE LIFT INSTITUTE, Cortland, NY (US)

(72) Inventors: Frederick G. Heath, Asheville, NC (US); Glenn D. Felpel, Powell, TN (US)

(73) Assignee: Automotive Lift Institute, Cortland, NY (US)

( * ) Notice: Subject to any disclaimer, the term of this patent is extended or adjusted under 35 U.S.C. 154(b) by 35 days.

(21) Appl. No.: 17/078,050

(22) Filed: Oct. 22, 2020

(65) Prior Publication Data

US 2021/0114852 A1 Apr. 22, 2021

Related U.S. Application Data

(60) Provisional application No. 62/924,535, filed on Oct. 22, 2019.

(51) Int. Cl.
*B66F 7/28* (2006.01)
*B66F 7/10* (2006.01)

(52) U.S. Cl.
CPC . *B66F 7/28* (2013.01); *B66F 7/10* (2013.01)

(58) Field of Classification Search
CPC ..... B66F 7/28; B66F 7/10; B66F 7/00; E05B 3/00; E05B 2009/004
See application file for complete search history.

(56) References Cited

U.S. PATENT DOCUMENTS 4,825,977 A 5/1989 Isogai
7,150,073 B2 * 12/2006 Stewart ..... E05D 11/1007 16/354

(Continued)

FOREIGN PATENT DOCUMENTS

CH 648268 A * 3/1985 ..... B66F 7/02
CN 107 215 815 A 9/2017

(Continued)

OTHER PUBLICATIONS

Document titled "TP11KC-DX Two Post Clear Floor 'Bi-Symmetric' Automotive Lift 11,000 lb. Capacity Installation & Operation Manual" dated May 2015, pp. 1-32.

(Continued)

*Primary Examiner* — Michael R Mansen
*Assistant Examiner* — Michelle M Lantrip
(74) *Attorney, Agent, or Firm* — Fay Sharpe LLP

(57) ABSTRACT

A swing arm restraint system for an automotive lift includes a movable carriage including a swing arm mounting portion. A first swing arm restraint housing is non-rotatably connected to the swing arm mounting portion, the first swing arm restraint housing including a first internal space. A first swing arm is pivotally connected to the swing arm mounting portion and is rotatable relative to the first swing arm restraint housing. A first restraint device is located in the first internal space and connected to the the swing arm restraint housing. A second restraint device is operably connected to the first swing arm such that the second restraint device rotates with the first swing arm relative to the first swing arm restraint housing. The first and second restraint devices are configured to be selectively arranged in either one of: (i) a locked position where the first and second restraint devices are non-rotatably coupled such that said first swing arm and said second restraint device are non-rotatably coupled to (Continued)

said first swing arm restraint housing; (ii) an unlocked position where the first and second restraint devices are decoupled with respect to each other such that said first swing arm and said second restraint device are rotatable relative to said first swing arm restraint housing.

8 Claims, 23 Drawing Sheets

(56) References Cited

U.S. PATENT DOCUMENTS

| | | | | |
|---|---|---|---|---|
| 2013/0233651 | A1 | 9/2013 | Kritzer | |
| 2017/0314304 | A1* | 11/2017 | Nguyen | E05B 63/042 |

FOREIGN PATENT DOCUMENTS

| | | | | | |
|---|---|---|---|---|---|
| CN | 108751002 | A | * | 11/2018 | B66F 7/02 |
| DE | 2751085 | A | * | 6/1978 | B66F 7/02 |
| DE | 28 41 022 | A1 | | 4/1980 | |
| DE | 3026160 | A1 | | 2/1982 | |
| DE | 691 07 560 | T2 | | 6/1995 | |
| DE | 102007020041 | A1 | * | 10/2008 | B66F 7/28 |
| DE | 102018105102 | A1 | * | 9/2019 | |
| EP | 0 478 035 | B1 | | 2/1995 | |
| EP | 1156009 | A1 | * | 11/2001 | B66F 7/28 |
| FR | 2 302 272 | | | 9/1976 | |
| KR | 960003806 | Y1 | * | 5/1996 | B66F 7/28 |
| KR | 100501430 | B1 | * | 7/2005 | |

OTHER PUBLICATIONS

Webpage printout titled "Freedomlift for Wheel-Free Maintenance Jobs" printed from https://stertilkoni.com/en/vehicle-lifts/2-post-lifts on May 8, 2019 (7 pages).

Webpage printout titled "Freedomlift—Single and double telescopic lifting arms" printed from https://stertilkoni.com on May 8, 2019 (5 pages).

International Search Report dated Feb. 23, 2021 for International Application No. PCT/US2020/056921.

Written Opinion of the Internationaliong Search Authority dated Feb. 23, 2021 for International Application No. PCT/US2020/056921.

* cited by examiner

AUTOMOTIVE LIFT AND SWING ARM RESTRAINT SYSTEM FOR AUTOMOTIVE LIFT

CROSS-REFERENCE TO RELATED APPLICATION

This application claims priority from and benefit of the filing date of U.S. provisional application Ser. No. 62/924,535 filed Oct. 22, 2019 and the entire disclosure of said provisional application is hereby expressly incorporated by reference into the present specification.

BACKGROUND

Automotive lift devices for lifting a truck or automobile are generally well known. One known type includes a pair of fixed vertical posts between which the vehicle is positioned. Each post includes a vertically movable carriage that, itself, includes first and second swing arms that each pivot or swing about a vertical swing axis relative to the carriage and that each extend and retract telescopically along its own longitudinal axis. To lift a vehicle, the vehicle is positioned between the posts and each of the four swing arms is pivoted and extended/retracted telescopically so that a lifting pad or lifting adapter portion at the distal end of the swing arm is positioned beneath the corresponding vehicle lift point designated by the vehicle manufacturer. Once the swing arms are each operatively positioned for lifting the vehicle, the lift is activated so that each carriage moves vertically upward along its respective post to lift and support the vehicle between the posts. The carriages are moved upward and downwardly on their respective posts using suitable drive mechanisms or actuators such as electrically, hydraulically, and/or pneumatically operated cylinders, jack screws, and/or other actuators that can both move and immovably support the vehicle load.

Although these known lifting devices include various restraint means for locking each of the swing arms in place with respect to its respective vertical swing axis once the swing arm is operatively positioned for lifting the vehicle, there have been instances where such known restraint devices have malfunctioned which results in a swing arm being dislodged from its operative lifting positioned beneath the vehicle lift point while the vehicle is elevated which can result in the vehicle falling from the lift. As such, manufacturers of such automotive lift devices have continuously sought to improve such swing arm restraint devices to prevent unintended pivoting of the swing arms relative to the carriage to increase the safety of such lifts.

SUMMARY

In accordance with one aspect of the present development, a swing arm restraint system for an automotive lift includes a movable carriage including a swing arm mounting portion. A first swing arm restraint housing is non-rotatably connected to the swing arm mounting portion, the first swing arm restraint housing including a first internal space. A first swing arm is pivotally connected to the swing arm mounting portion and is rotatable relative to the first swing arm restraint housing. A first restraint device is located in the first internal space and connected to the swing arm restraint housing. A second restraint device is operably connected to the first swing arm such that the second restraint device rotates with the first swing arm relative to the first swing arm restraint housing. The first and second restraint devices are configured to be selectively arranged in either one of: (i) a locked position where the first and second restraint devices are non-rotatably coupled such that said first swing arm and said second restraint device are non-rotatably coupled to said first swing arm restraint housing; (ii) an unlocked position where the first and second restraint devices are decoupled with respect to each other such that said first swing arm and said second restraint device are rotatable relative to said first swing arm restraint housing.

In accordance with another aspect of the present development, a carriage for an automotive lift includes a frame. First and second swing arms are pivotally connected to the frame. The first swing arm is adapted for pivoting movement relative to the frame about a first swing axis and the second swing arm is adapted for pivoting movement relative to the frame about a second swing axis that is parallel to and spaced-apart from the first swing axis. A first swing arm restraint system is connected to the frame for selectively restraining pivoting movement of the first swing arm about the first swing axis. A second swing arm restraint system is connected to the frame for selectively restraining pivoting movement of the second swing arm about the second swing axis. The first and second swing arm restraint systems each include a first restraint device non-rotatably connected to the frame and a second restraint device non-rotatably connected to the swing arm. The first and second restraint devices are selectively positioned relative to each other in either: (i) a locked position where the first and second restraint devices are non-rotatably coupled; or (ii) an unlocked position where the first and second restraint device are decoupled and said second restraint device is rotatable relative to said first restraint device. The second restraint device of the first swing arm restraint system is rotatable relative to the first restraint device of the first swing arm restraint system about said first swing axis when the first swing arm restraint system is in said unlocked position. The second restraint device of the second swing arm restraint system is rotatable relative to the first restraint device of the second swing arm restraint system about the second swing axis when the second swing arm restraint system is in the unlocked position.

In accordance with another aspect of the present development, an automotive lift includes at least one lift column including a movable carriage. The carriage includes a frame and at least a first swing arm pivotally connected to the frame. The first swing arm is adapted for pivoting movement relative to the frame about a first swing axis. A first restraint device is non-rotatably connected to the frame and a second restraint device is non-rotatably connected to the first swing arm. The first and second restraint devices are selectively arranged in a locked position in which the first and second restraint devices are non-rotatably coupled and an unlocked position in which the first and second restraint devices are decoupled from each other. The second restraint device is rotatable relative to the first restraint device about the first swing axis when the first and second restraint devices are located in the unlocked position.

DETAILED DESCRIPTION OF THE PRESENT DISCLOSURE

Figure 1:
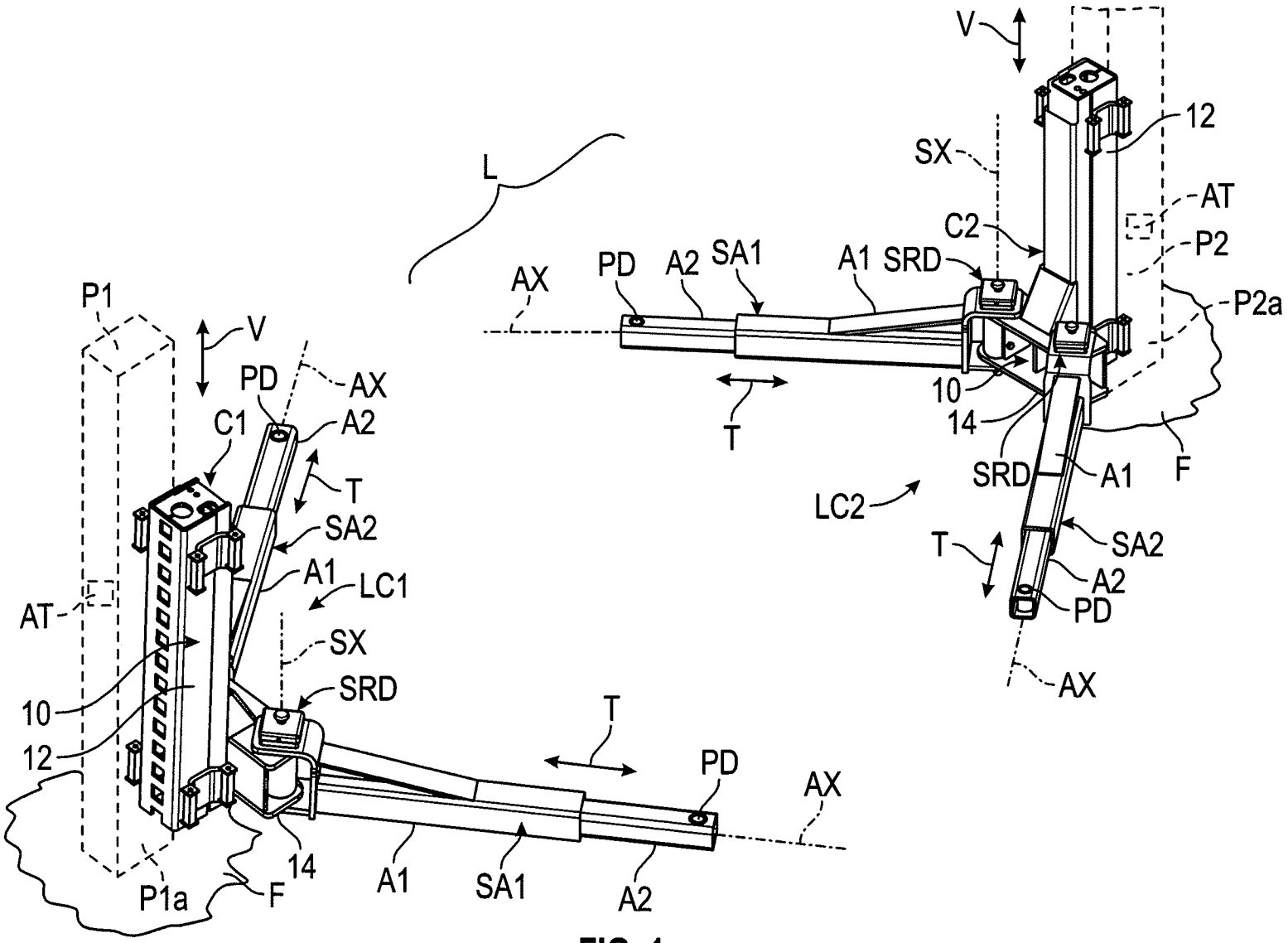
FIG. 1 illustrates an automotive lift including first and second lift columns that each include a swing arm restraint system and swing arm restraint device provided in accordance with one embodiment of the present disclosure.

FIG. 1 illustrates an automotive lift L provided in accordance with an embodiment of the present disclosure. The term "automotive" is intended to encompass any motor vehicle such as passenger car, light truck, sport utility vehicle, commercial truck or other commercial vehicle or any other motor vehicle. The lift L includes first and second (left and right) lift columns LC1,LC2 each of which comprises a respective fixed vertical post P1,P2 that is immovably secured to a shop floor F or other support surface or support structure. The first and second lift columns LC1, LC2 further respectively comprise first and second carriages C1,C2 movably connected to the posts P1,P2 and adapted for reciprocal vertical movement (indicated by double-ended arrows V) along the post P1,P2 between a lowered positioned (as shown in FIG. 1) where the carriage C1,C2 is located adjacent the shop floor F near a lower end P1*a*,P2*a* of the post and a raised position (not shown) where the carriage C1,C2 is spaced vertically above the shop floor F and spaced vertically above the lower end P1*a*,P2*a* of the post. At least one and preferably each carriage C1,C2 is provided in accordance with an embodiment of the present invention.

The first and second lift columns LC1,LC2 are spaced-apart from each other sufficiently for a vehicle to be positioned there between. Each carriage C1,C2 includes at least one and preferably first and second swing arms SA1,SA2 that each pivot or swing about a respective vertical swing axis SX relative to the carriage C1,C2 (see also FIG. 2), i.e., a first swing axis SX for the first swing arm SA1 and a second swing axis SX for the second swing arm SA2. Each swing arm SA1,SA2 includes an inner segment A1 that is pivotally secured to the carriage C1,C2 for pivoting movement on an arc relative to the carriage C1,C2 about the respective swing axis SX. Each swing arm SA1,SA2 further includes an outer segment A2 that is telescopically or otherwise slidably connected to the inner segment A1 such that the outer segment A2 can be manually or otherwise extended or retracted relative to the inner segment A1 along a swing arm longitudinal axis AX (as indicated by the double-ended arrows T) that lies normal to the respective swing axis SX of the swing arm SA1,SA2. In the illustrated embodiment, the inner segment A1 comprises a tubular structure such as the illustrated rectangular tubular structure that internally slidably receives the outer segment A2 in telescopic manner (and the outer segment A2, itself, can also include multiple telescopically nested segments or pivotable segments). A pin or other lock or retainer mechanism can be provided and selectively engaged with the inner and outer swing arm segments A1,A2 to lock the outer segment A2 in a fixed position relative to the inner segment A1 to prevent unintended sliding extension/retraction movement of the outer segment A2 relative to the inner segment A1 along the longitudinal swing arm axis AX.

To lift a vehicle, the vehicle is positioned between the lift columns LC1,LC2 and each of the four swing arms SA1, SA2 is pivoted about its respective swing axis SX and extended/retracted telescopically so that a lifting adapter or lifting pad PD at the distal end of the arm SA1,SA2 is positioned beneath a corresponding lift point on the vehicle such as on the vehicle body or frame. Once the swing arms SA1,SA2 are each operatively positioned for lifting the vehicle and locked in positioned as described in detail below, the lift L is activated so that each carriage C1,C2 moves vertically upward along its respective post P1,P2 in unison with the other carriage C1,C2 as indicated by the arrows V to lift and support the vehicle between the posts P1,P2. Each lift column LC1,LC2 includes a suitable drive mechanism or actuator AT operably connected between the post P1,P2 and the corresponding carriage C1,C2 to move the carriage C1,C2 (and the vehicle supported on the arms SA1,SA2) vertically in opposite directions V along the post P1,P2. Examples of suitable actuators AT for moving the carriage C1,C2 include electrically, hydraulically, and/or pneumatically operated cylinders, jack screws, and/or other actuators AT that can both move and immovably support the vehicle load, but any other suitable actuator can be used.

Alternatively, the lift L can comprise only a single lift column LC1 or LC2 and the respective carriage C1 or C2 can include one or more swing arms SA1,SA2 adapted to support the associated automobile or other vehicle in a cantilevered manner.

In another embodiment, all or part of each lift column LC1,LC2 such as the post P1,P2 can be located beneath or recessed with respect to the floor F or other support surface F while the carriage C1,C2 is selectively extensible above the floor F or other support surface.

In another embodiment the lift column LC1,LC2 or each lift column LC1,LC2 can be fixedly secured to a support structure other than the floor F such as an overhead beam, a vertical support beam, or any other support structure.

Figure 2:
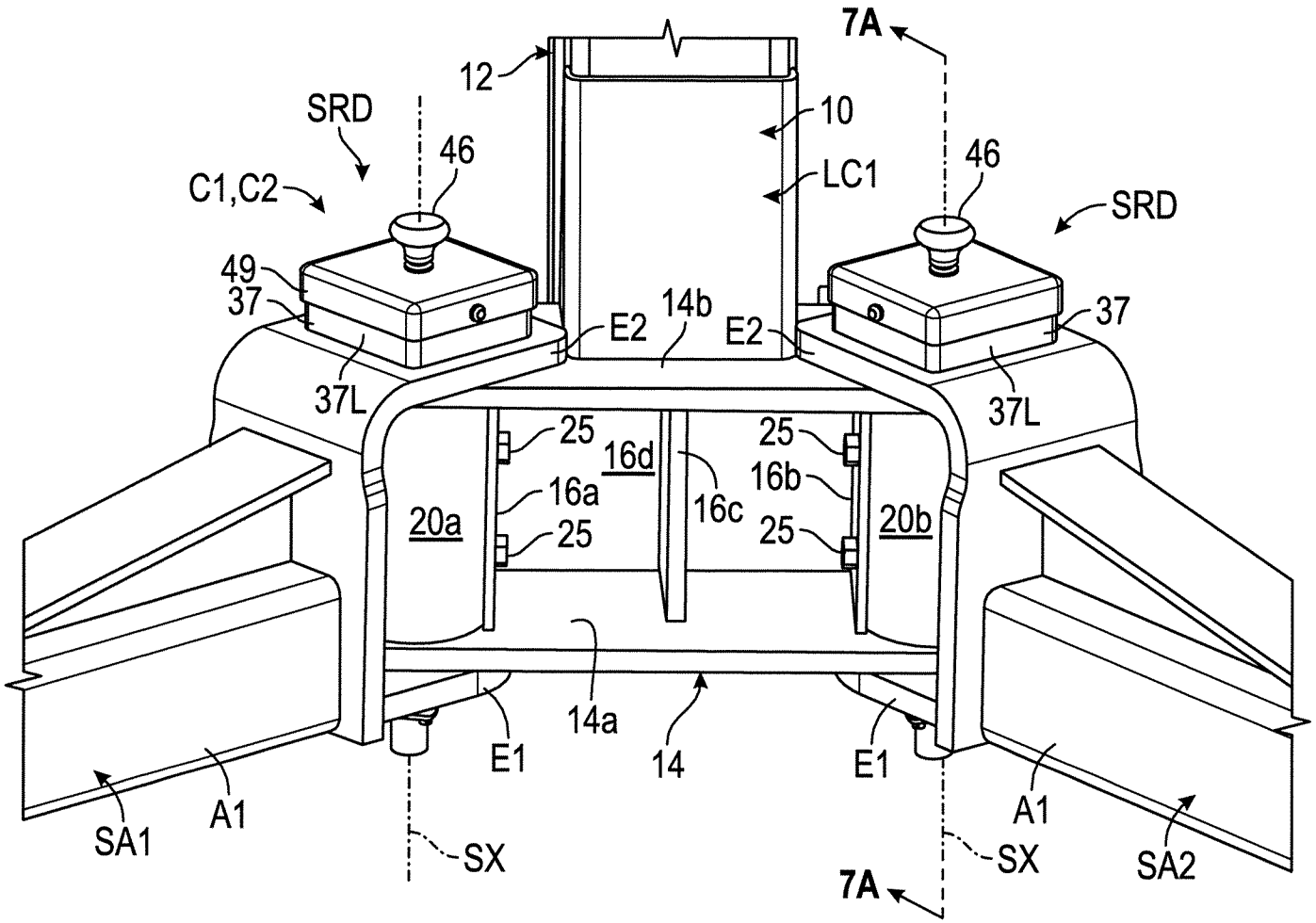
FIG. 2 is a partial isometric view of a carriage of the automotive lift of FIG. 1 and partially illustrates first and second swing arms that respectively include first and second swing arm restraint devices according to an embodiment of the present disclosure.

With continuing reference to FIGS. 1 & 2, in the illustrated embodiment, each carriage C1,C2 includes a frame 10 including an elongated base 12 that is slidably engaged with the respective post P1,P2 and includes a swing arm connection portion or swing arm mounting portion 14 connected to the base 12 and to which the swing arms SA1,SA2 are pivotally connected. With particular reference to FIG. 2, the swing arm mounting portion 14 includes first and second vertically spaced-apart mounting plates 14*a*,14*b* connected together by one or more cross ribs 16*a*,16*b*,16*c*. In the illustrated example, the cross ribs 16 comprise first and second vertical cross ribs 16*a*,16*b* located on the opposite lateral sides of the swing arm mounting portion 14 and a central vertical cross rib 16*c* located between the first and second cross ribs 16*a*,16*b*, but other arrangements can be used. A transversely extending vertical backing plate 16*d* is also optionally provided and welded to the first, second, and central (third) cross ribs 16*a*-16*c* and also to the first and second horizontal mounting plates 14*a*,14*b* for added strength. The base 12 and swing arm mounting portion 14 of the frame 10 preferably comprise a fabricated metal structure including multiple steel, aluminum, or other metallic plates and components that are welded, fastened, fitted, and/or otherwise connected together to define the frame 10, and the carriage frame 10 can further comprise other metallic or non-metallic components such as extruded or cast metallic parts and/or polymeric parts. In operative use, the base 12 of the carriage frame 10 is typically vertically oriented and the mounting plates 14*a*, 14*b* are typically horizontally oriented.

Figure 3:
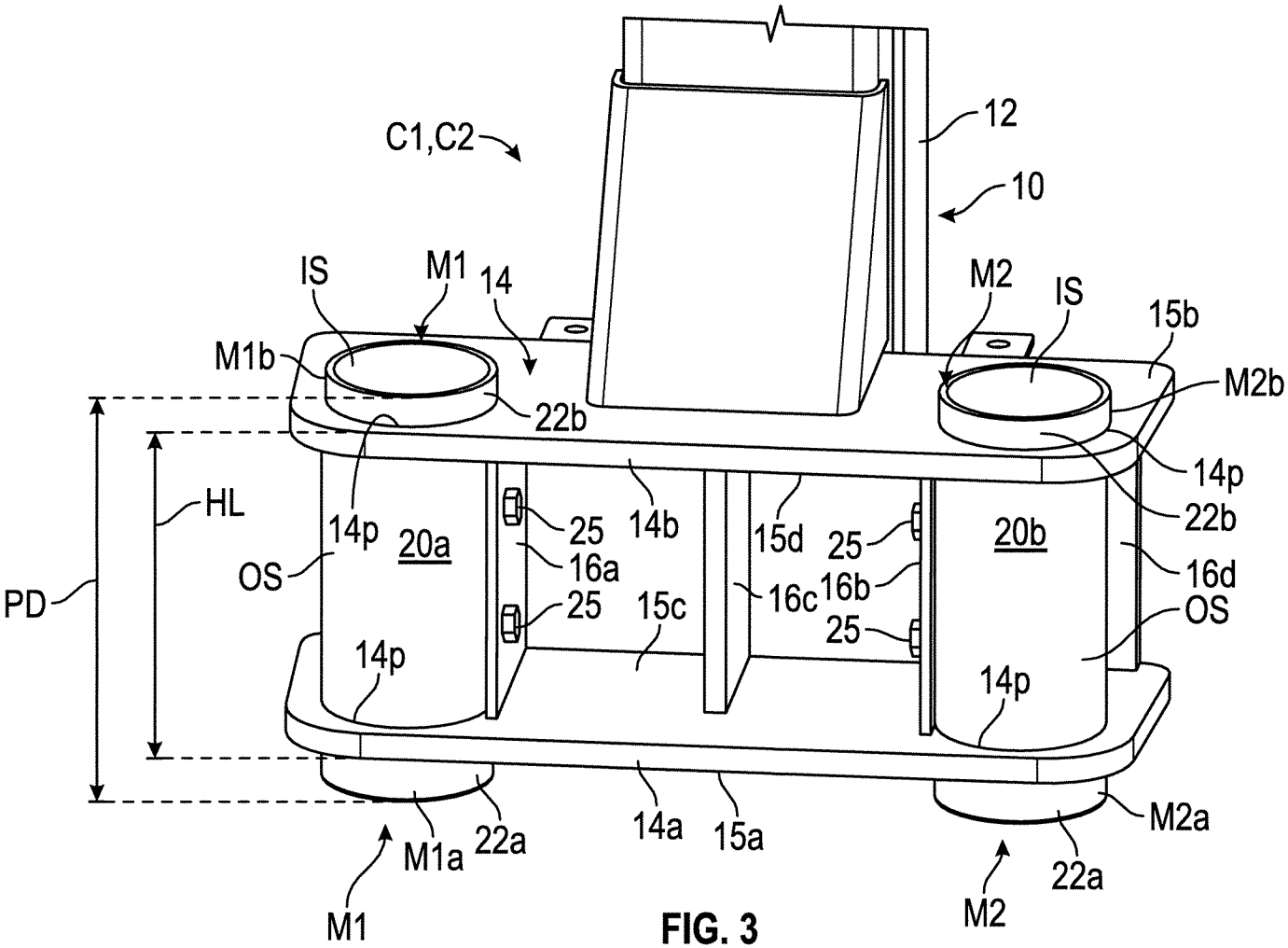
FIG. 3 is a partial isometric view of the carriage of FIG. 1, with the swing arms and other portions removed to illustrate connection of the first and second swing arm restraint housings to the frame of the carriage and to illustrate the cylindrical swing arm mounts.

Referring particularly to FIGS. 2 & 3, the carriage C1,C2 is partially shown. Except for their location on the shop floor F, the first and second lift columns LC1,LC2 are otherwise identical to each other insofar as the present disclosure is concerned. As such, to facilitate the description, the present development will sometimes be described below with reference only to the first lift column LC1 and the carriage C1 thereof, but those of ordinary skill in the art will recognize that the following description applies correspondingly to the second lift column LC2 and its carriage C2.

The carriages C1,C2 each further comprise a swing arm restraint system comprising a swing arm restraint device SRD associated with the or each swing arm SA1,SA2. In the illustrated embodiment, the carriages C1,C2 each include first and second swing arms SA1,SA2 and correspondingly include first and second swing arm restraint devices SRD (FIG. 2) respectively associated with the first and second swing arms for respectively selectively restraining or locking the first and second swing arms SA1,SA2 in a select fixed angular position about their respective swing axes SX relative to the swing arm mounting portion 14 of the frame 10. First and second swing arm restraint housings or swing arm restraint housing tubes 20*a*,20*b* are fixedly secured to the swing arm mounting portion 14. As shown, the housing tubes 20*a*,20*b* (generally 20) are respectively located on opposite first and second lateral sides of the swing arm mounting portion 14. The swing arm restraint housing tubes 20*a*,20*b* are preferably identical to each other and are tubular and are cylindrical in the illustrated example of FIGS. 1-8 (see also the section view of FIG. 5A) such that they comprise a cylindrical outer surface OS and a cylindrical inner surface IS. Each swing arm restraint housing tube 20*a*,20*b* is fitted into a pair of aligned circular mounting apertures 14*p* (FIG. 3) that are defined in the mounting plates 14*a*,14*b*, i.e., the first swing arm restraint housing tube 20*a* is installed in a first aligned pair of mounting apertures 14*p* that are defined respectively in the first and second mounting plates 14*a*,14*b*, and the second swing arm restraint housing tube 20*b* is installed in a second aligned pair of mounting apertures 14*p* are defined respectively in the first and second mounting plates 14*a*,14*b*. In the illustrated embodiment, the swing arm restraint housing tubes 20*a*,20*b* are fixedly secured to the swing arm mounting portion 14 of the frame 10 by one or more bolts, pins, keys, and/or other fasteners 25 installed in corresponding apertures 20*p* located in the swing arm restraint housing tube 20*a*,20*b* (see FIG. 6) or otherwise engaged with the housing tube 20*a*,20*b*, with the first swing arm housing tube 20*a* bolted or otherwise fastened to the first cross rib 16*a* and the second swing arm housing tube 20*b* bolted or otherwise fastened to the second cross rib 16*b*. In one example, the housing apertures 20*p* are tapped bores and the fasteners 25 are threaded bolts installed in the apertures 20*p*. Use of removable fasteners 25 allows the swing arm housing tubes 20*a*,20*b* to be assembled to and removed from the swing arm mounting portion 14 of the frame 10 as is required for assembly and repair. Alternatively, the swing arm restraint housing tubes 20*a*,20*b* can be otherwise fixedly secured to the first and second mounting plates 14*a*,14*b* or other part(s) of the swing arm mounting portion by welding, fasteners, flanges connected to or formed on the tubes 20*a*,20*b*, or any other suitable connection method or structure.

The first and second mounting plates 14*a*,14*b* comprise respective outer faces 15*a*,15*b* that each face outwardly away from the other mounting plate 14*a*,14*b*. On an opposite side, the first and second mounting plates 14*a*,14*b* further comprise respective inner faces 17*a*,17*b* that each face inwardly toward each other and toward the other mounting plate 14*a*,14*b*. Each swing arm restraint housing tube 20*a*, 20*b* comprises an axial length HL (FIG. 3) that is greater than an outside plate distance PD defined between the opposite outer faces of the mounting plates 14*a*,14*b*. The housing tubes 20*a*,20*b* are installed such that the first and second opposite ends 22*a*,22*b* of the first swing arm tube 20*a* project respectively outwardly from respective outer faces 15*a*,15*b* the first and second mounting plates 14*a*,14*b* and respectively define a first pair of cylindrical swing arm mounts M1*a*,M1*b* located respectively adjacent the outer faces 15*a*,15*b*. Likewise, the first and second opposite ends 22*a*,22*b* of the second swing arm housing tube 20*b* project respectively outwardly from respective outer faces 15*a*,15*b* of the first and second mounting plates 14*a*,14*b* and respectively define a second pair of cylindrical swing arm mounts M2*a*,M2*b* located respectively adjacent the outer faces 15*a*, 15. In the case where the swing arm restraint housing tubes 20*a*,20*b* do not include a cylindrical outer surface such as when they do not comprise a cylindrical cross-section (see e.g., FIGS. 11-16), the cylindrical mounts M1*a*,M1*b* and M2*a*,M2*b* can be provided by separate annular boss structures secured to the housing tubes 20*a*,20*b* that each include a cylindrical outer surface or outside diameter to provide the first and second pairs of swing arm mounts M1*a*,M1*b* and M2*a*,M2*b*. The first pair of swing arm mounts M1*a*,M1*b* (generally referred to as the first swing arm mounts M1) define a first trunnion structure for rotatably supporting the first swing arm SA1. The second pair of swing arm mounts M2*a*,M2*b* (generally referred to as the second swing arm mounts M2) define a second trunnion structure for rotatably supporting the second swing arm SA2.

Figure 4:
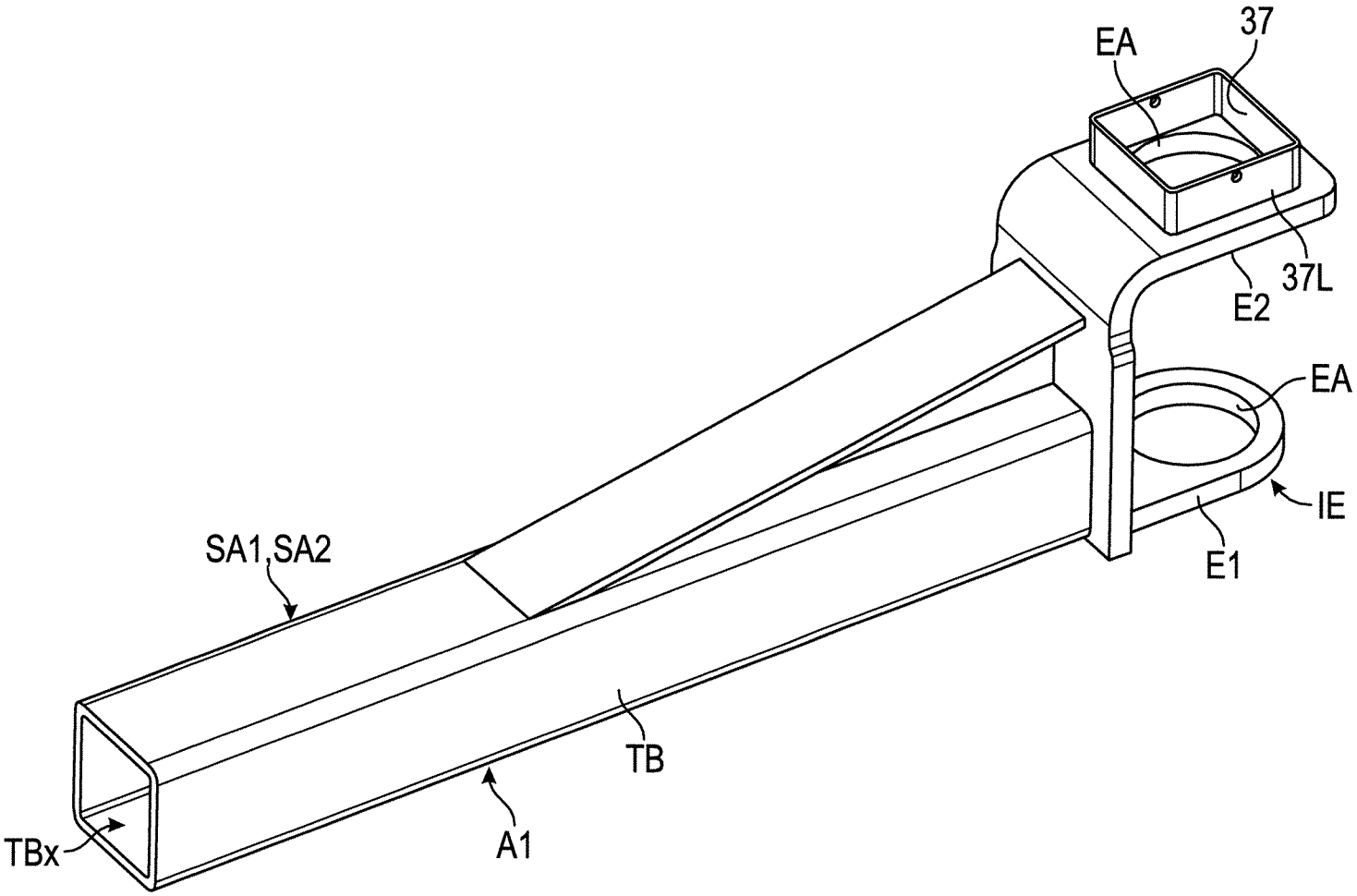
FIG. 4 is an isometric view that shows an inner segment of a swing arm of the lift of FIG. 1 by itself.

An embodiment of an inner segment A1 of the first and second swing arms SA1,SA2 is shown in FIG. 4. In general, the inner segment A1 is defined from multiple steel or other metallic members that are welded or fastened together. The inner segment A1 comprises a tubular body TB including a bore TBx for slidably receiving the outer segment A2 of the swing arm SA1,SA2. The inner segment A1 also includes a bifurcated inner end IE connected to the tubular body TB comprising first (lower) and second (upper) spaced-apart mounting ears E1,E2 that define a yoke structure. The first and second mounting ears E1,E2 comprise respective circular mounting apertures EA defined therein that are dimensioned to closely respectively receive: (i) the first pair of swing arm mounts M1*a*,M1*b* therein (for the first swing arm SA1); or (ii) the second pair of swing arm mounts M2*a*,M2*b* therein (for the second swing arm SA2). As such, the first and second swing arms SA1,SA2 are respectively pivotally mounted on the first and second swing arm mounts M1,M2. In an alternative embodiment, the swing arm mounting ears E1,E2 are spaced-apart a distance that allows one or both of them to be positioned between the first and second mounting plates 14*a*,14*b* of the frame 10 (rather than outside the plates 14*a*,14*b* as shown herein), in which case the length HL of the swing arm restraint housing tube 20*a*,20*b* can be shortened and need not be longer than the plate distance PD since one or both of the first and second swing arm mounts M1,M2 is/are defined by a portion of the cylindrical outer surface OS located between the first and second mounting plates 14*a*, 14*b*. In either case, the cylindrical outer surface OS of the swing arm restraint housing tube 20 or the cylindrical outer surface of an annular boss secured to the housing tube 20 provides the first and second swing arm mounts M1,M2 that are pivotally engaged with the apertures EA of the respective ears E1,E2.

Figure 5A:
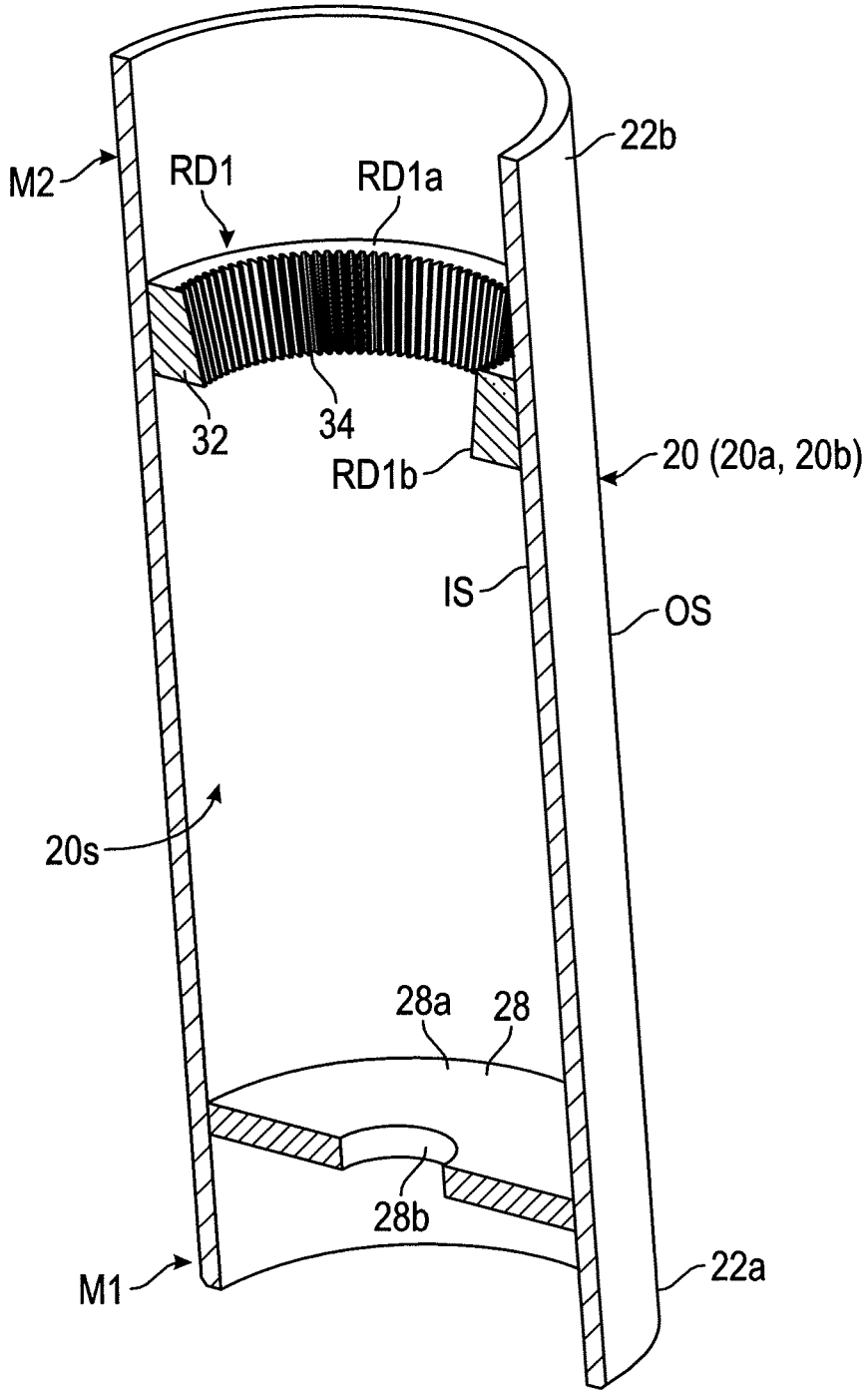
FIG. 5A is an isometric section view of a swing arm restraint housing provided in accordance with an embodiment of the present disclosure.

As shown in the section view of FIG. 5A, each swing arm restraint housing tube 20 (20*a*,20*b*) further comprises a hollow interior bore or space 20*s* (a first internal space 20*s* for the first housing tube 20*a* and a second internal space 20*s* for the second housing tube 20*b*) defined by the inner cylindrical surface IS in the illustrated embodiment of FIGS. 1-8. A first or outer restraint body or restraint device RD1 is non-rotatably connected to and/or formed as a part of the inner surface IS inside the space 20*s* and defines an annular body RD1*a* with a hollow central opening RD1*b*. In the illustrated embodiment, the first restraint device RD1 comprises a ring gear 32 comprising a plurality of internal teeth 34 that may straight or be beveled as shown such that the central opening RD1*b* diverges radially outward as the teeth 34 extend toward the second (upper) end 22*b* of the housing 20. A guide wall 28 is also located in and extends across the internal housing space 20*s*, between the first restraint device RD1 and the first (lower) end 22*a* of the housing 20. The guide wall 28 comprises a body 28*a* and a central opening 28*b*. As described below with reference to FIGS. 11-16, the hollow interior bore/space 20*s* can have a non-cylindrical inside shape such as square or otherwise rectangular as defined by the inner surface IS.

Figure 5B:
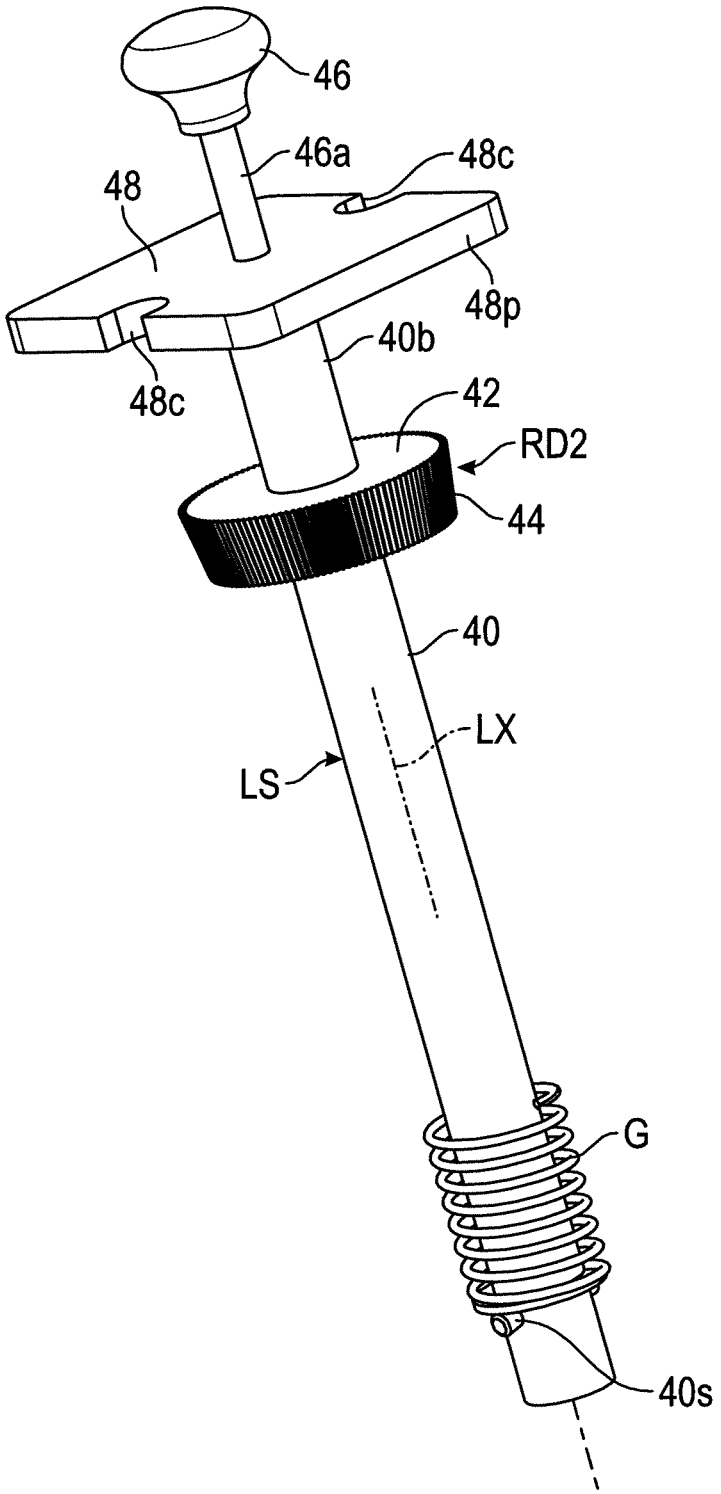
FIG. 5B is an isometric view of a swing arm restraint lock shaft provided in accordance with an embodiment of the present disclosure.
Figure 6:
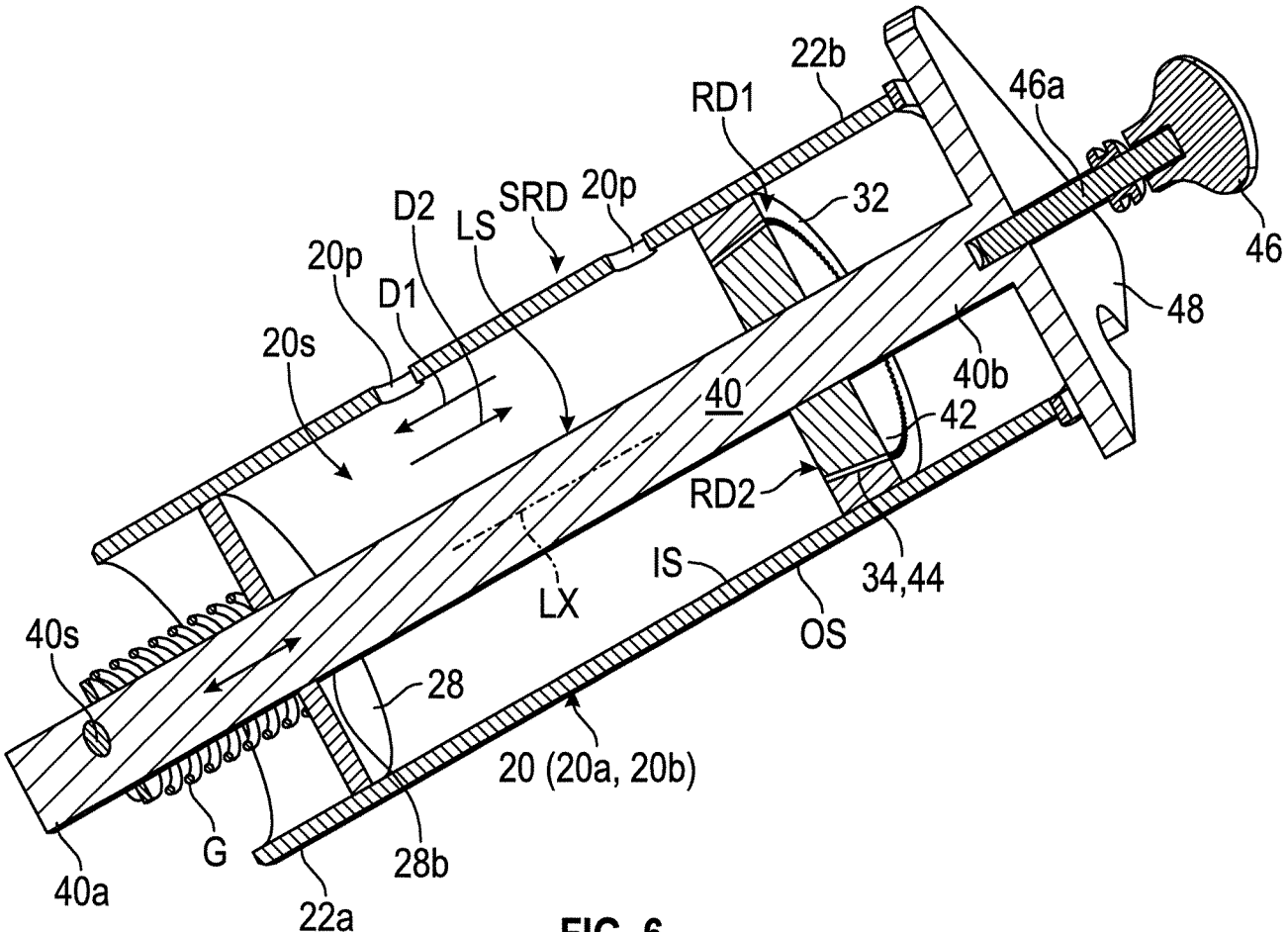
FIG. 6 is an isometric section view that shows the swing arm restraint lock shaft of FIG. 5B operatively installed in the housing of FIG. 5A to provide a swing arm restraint device in accordance with an embodiment of the present disclosure.

With reference also to FIGS. 5B and 6, each swing arm restraint device SRD further comprises a swing arm restraint lock assembly comprising a lock shaft LS coaxially assembled to the housing tube 20, with the lock shaft centrally and coaxially installed in the bore 20*s* of the housing tube 20. The lock shaft LS comprises an elongated rod 40 that extends axially along a lock axis or locking axis LX (a first lock axis or first locking axis LX for the swing arm restraint device SRD of the first swing arm SA1 and a second lock axis or second locking axis LX for the swing arm restraint device SRD of the second swing arm SA2) and further comprises a second or inner restraint body or restraint device RD2 non-rotatably secured to the rod 40. In the illustrated embodiment, the second restraint device RD2 comprises a gear 42 with external teeth 44 adapted to mesh with and engage the internal teeth 34 of the ring gear 32. The second (inner) restraint device RD2 is conformed and dimensioned to selectively non-rotatably mate with the first (outer) restraint device RD1 when the second restraint device RD2 is coaxially received in the central opening RD1*b* of the first restraint device RD1, such that the first and second restraint devices RD1,RD2 are non-rotatably engaged with each other when so mated. The lock shaft LS is movable in first and second opposite directions D1,D2 in the housing tube 20 coaxially along the locking axis LX to selectively engage and disengage the second restraint device RD2 (inner gear 42) from the first restraint device RD1 (outer gear 32). As noted above, the ring gear 32 of the first restraint device RD1 can be a bevel gear, in which case the gear 42 of the second restraint device RD2 is also a bevel gear formed to mate with the ring gear 32 by axially sliding into the central opening RD1*b* of the ring gear 32. The teeth 34,44 can alternatively be straight teeth that are not beveled, but the use of bevel gears 32,42 shortens the axial movement required for the inner gear 42 to disengage from the outer gear 42 as compared to gears of similar axial thickness that include straight (non-beveled teeth).

Figure 6A:
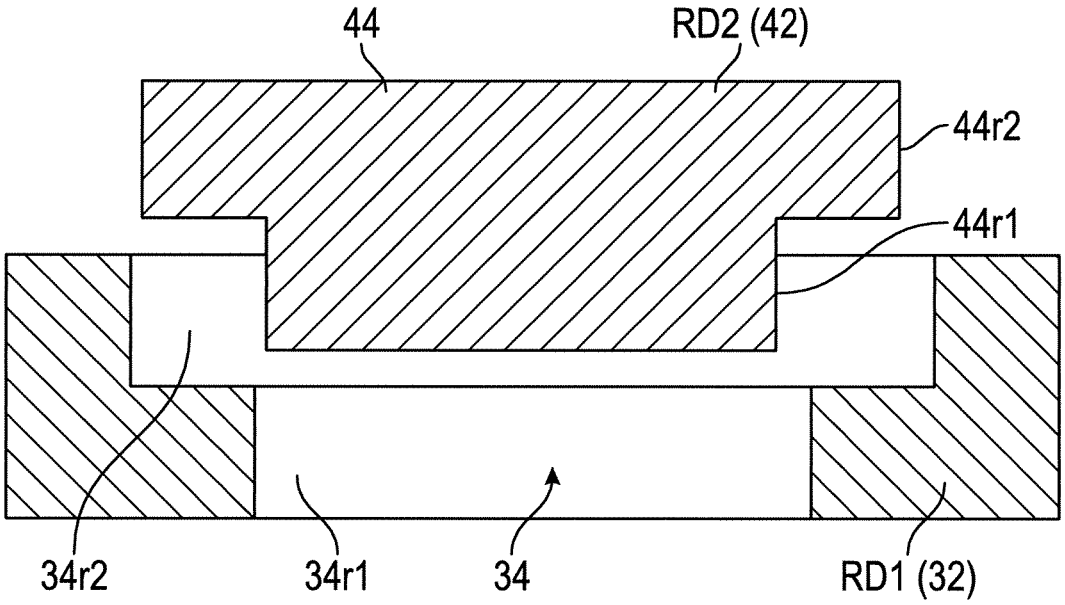
FIG. 6A illustrates an alternative embodiment of the first (outer) and second (inner) restraint devices comprising respective stepped gears.

FIG. 6A illustrates another alternative embodiment of the first/outer and second/inner restraint devices RD1,RD2, wherein the outer gear 32 comprises a stepped straight tooth structure comprising first and second rows 34*r*1,34*r*2 of internal teeth 34 wherein the first row 34*r*1 defines a smaller inside diameter as compared to the second row 34*r*2. The inner gear 42 likewise comprises a stepped straight tooth structure comprising first and second rows 44*r*1,44*r*2 of external teeth 44, wherein the first row 44*r*1 has a smaller outside diameter as compared to the second row 44*r*2. Accordingly, the respective first rows of teeth 34*r*1,44*r*1 and the respective second rows of teeth 34*r*2,44*r*2 mate and engage when the inner gear 42 is moved axially into engagement with the outer gear 32. The stepped structure reduces the axial distance or "travel" required to disengage the inner gear 42 from the outer gear 42 without reducing the total axial length of gear tooth engagement between the internal teeth 34 and the external teeth 44 in order to provide reduced travel for disengagement without a corresponding reduction in strength.

In another alternative embodiment described in more detail below in relation to FIGS. 9 & 10, the internal teeth 34 of the outer ring gear 32 and external teeth 44 of the inner gear 42 are eliminated entirely to provide smooth mating tapered surfaces whereby the smooth tapered central opening RD1*b* of the first restraint device RD1 defines the female side of a self-holding or self-locking taper coupler (such as a Morse taper coupling or another self-holding taper coupling) and the smooth correspondingly tapered outer surface of the second restraint device RD2 defines the male side of the self-holding or self-locking taper coupling for non-rotatably connecting the first and second restraint devices RD1, RD2 via friction when the respective inner and outer tapered surfaces of the first and second restraint devices RD1, RD2 are abutted and axially loaded.

Referring also to FIG. 6, the rod 40 comprises a first or lower end 40*a*, and a second or upper end 40*b*. Between its opposite ends 40*a*,40*b* the rod 40 passes through the aperture 28*b* in the guide plate 28 with minimal clearance such that the guide plate 28 supports and centers the rod coaxially in the space 20*s* of the housing tube 20. A knob or other handle 46 is defined as part of and/or connected to the second rod end 40*b* and is adapted for manual grasping by a human operator to move the rod 40 axially in a second direction D2 such that the second (upper) end 40*b* of the rod 40 moves away from the first (lower) end 22*a* of the housing tube 20. In the illustrated embodiment, the handle 46 includes an elongated extension 46*a* that is threaded or otherwise secured to the upper end 40*b* of the rod 40 and that forms an extension of the upper end 40*b* of the rod 40.

The swing arm restraint device SRD further comprises a spring G operatively engaged between the rod 40 and the housing tube 20 that continuously biases the rod 40 in a first direction toward the first (lower) end 20*a* of the housing tube 20. In the illustrated embodiment, the spring G is a coil spring coaxially installed on the rod 40 between the guide plate 28 and the first end 40*a* of the rod. A stop 40*s* is connected to and/or formed as part of the rod 40 between the spring G and the first rod end 40*a* and captures the spring G on the rod between the stop 40*s* and the guide plate 28 such that the spring G acts against the guide plate 28 and the stop 40*s* to continuously bias the rod 40 toward the first end 22*a* of the housing 20. The first end 40*a* of the rod 40 projects outwardly from the first end 22*a* of the swing arm restraint housing tube 20 and also projects outwardly with respect to the first mounting plate 14*a* of the swing arm mounting portion 14 and also with respect to the first ear E1 of the swing arm SA1,SA2.

Between the knob 46 and the second restraint device RD2 (gear 42), the lock shaft LS further comprises an enlarged torque transfer plate or head 48 connected to and/or formed as part of the rod 40. The torque transfer head 48 and restraint device RD2 (gear 42) are non-rotatably connected through the rod 40 in the illustrated example) such that rotation of the torque transfer head 48 about the lock axis LX induces corresponding rotation of the rod 40 and second restraint device RD2 (gear 42) about the lock axis LX. In the illustrated example of FIG. 6, the torque transfer head 48 is formed as a one-piece construction as part of the rod 40 but is can alternatively be formed as part of and/or connected to the gear 42.

Figure 7A:
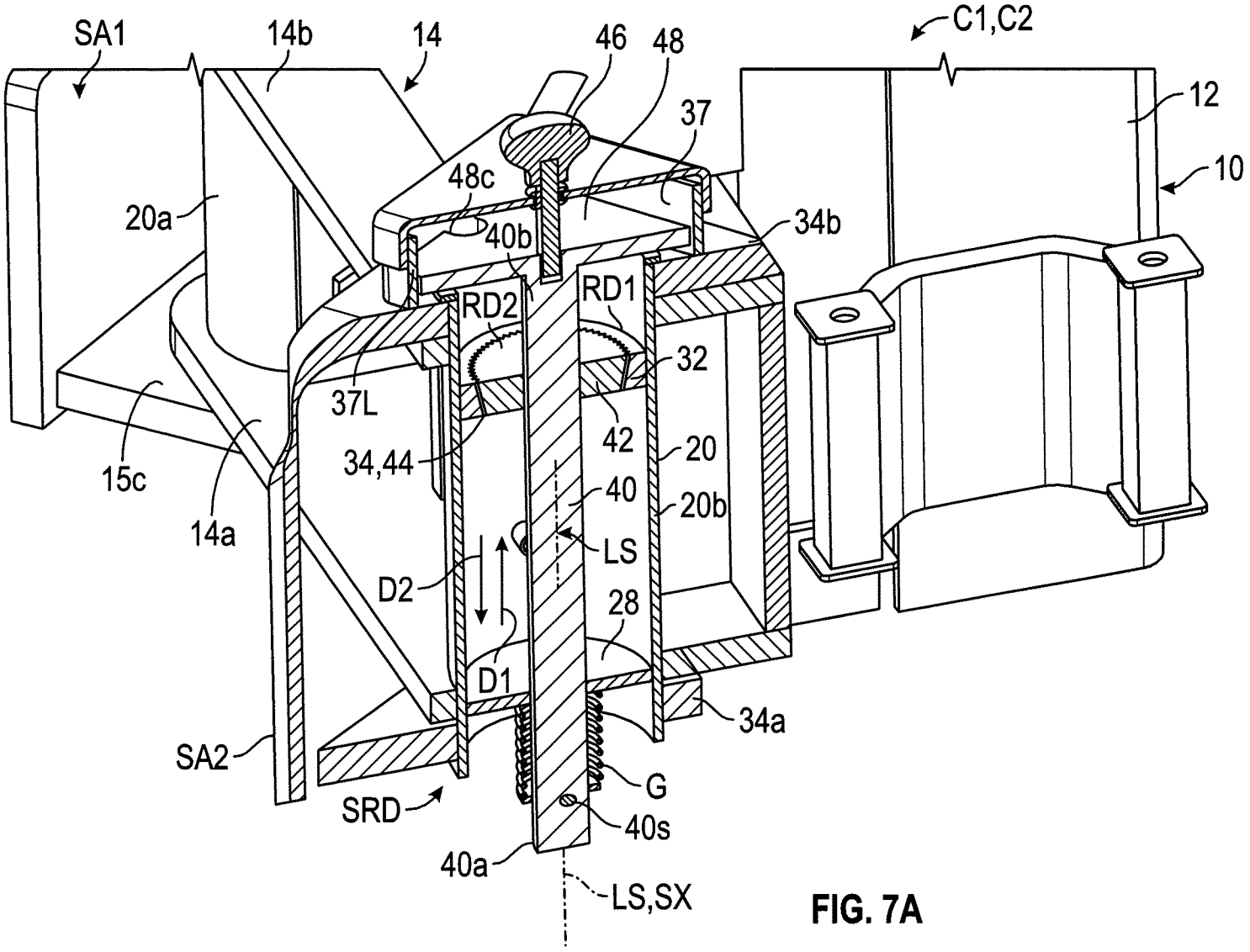
FIG. 7A is a section view as taken at line 7A-7A of FIG. 2 showing the swing arm restraint device and the lock shaft thereof in a locked configuration.
Figure 7B:
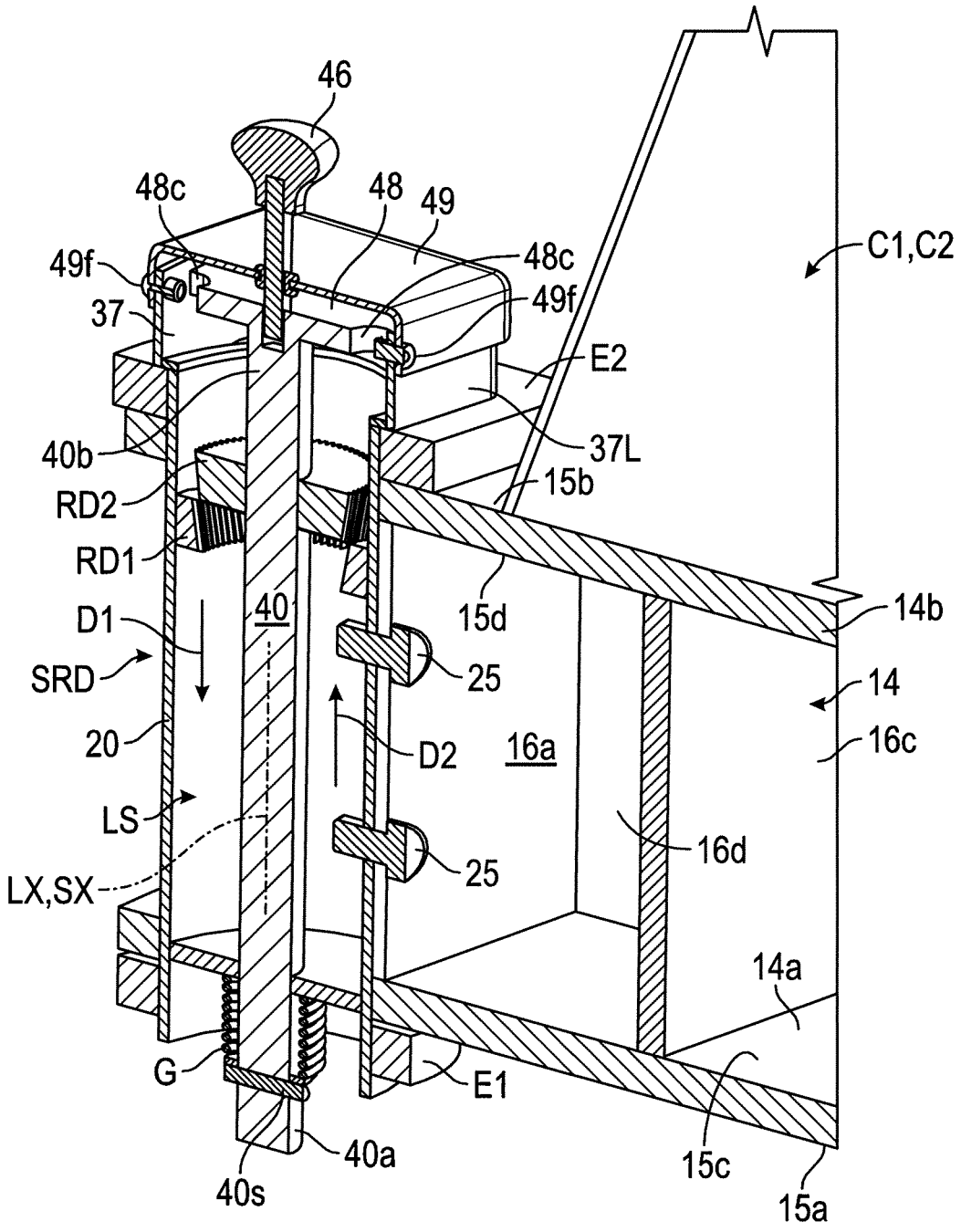
FIG. 7B is a section view that is similar to FIG. 7A but that shows the swing arm restraint device and the lock shaft thereof in an unlocked configuration.
Figure 8:
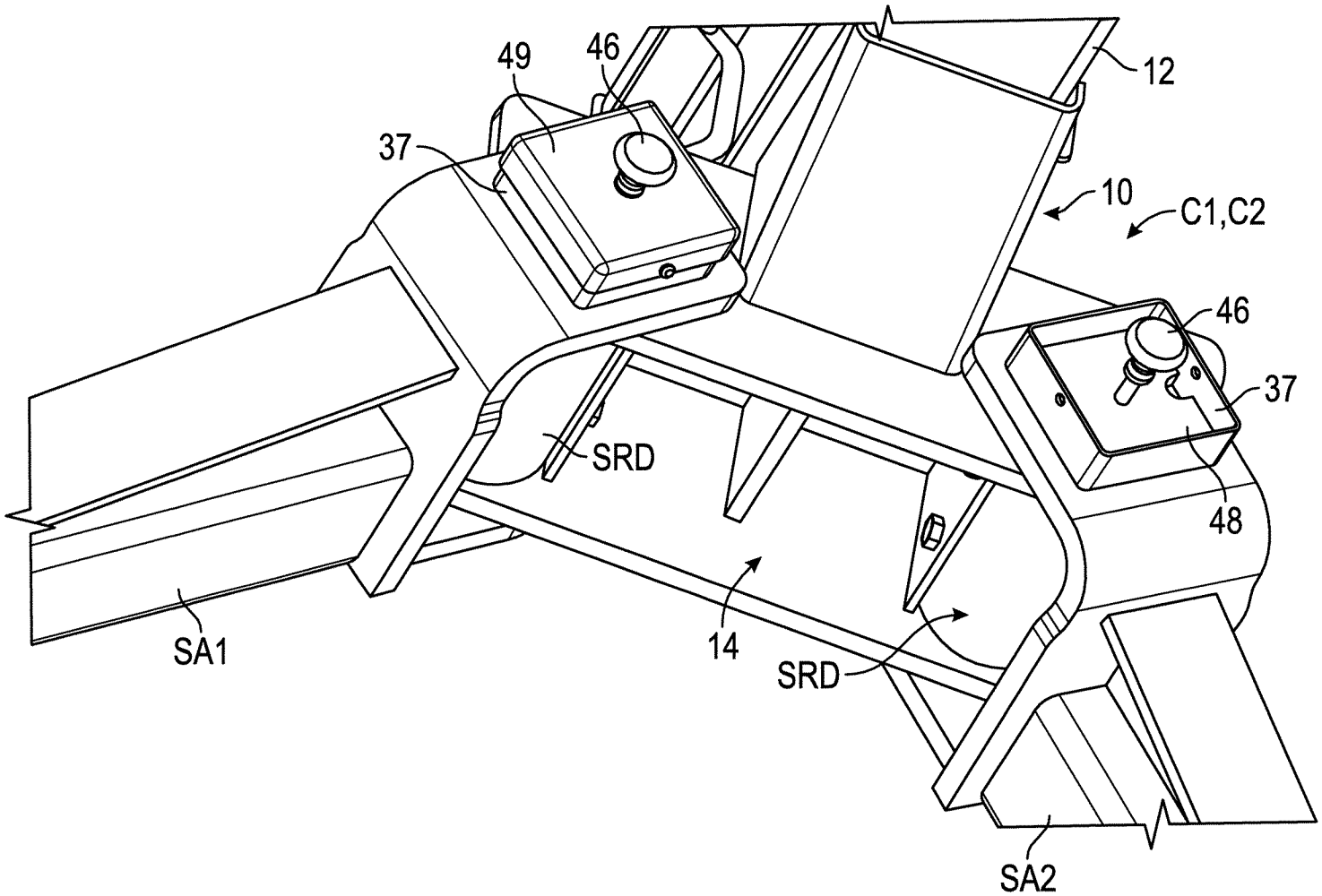
FIG. 8 is similar to FIG. 2 but with one of the optional covers removed to reveal an embodiment of a non-rotatable connection between a swing arm and its corresponding swing arm restraint device.

With particular reference now to FIGS. 6, 7A, and 7B, when the swing arm restraint device SRD is operatively installed on a carriage C1,C2, with the housing tube 20 thereof connected to the swing arm mounting portion 14 of the frame as described above as shown in FIG. 7A, the torque transfer head 48 of the swing arm restraint device SRD is non-rotatably connected or coupled to the swing arm SA1,SA2 that is pivotally connected or coupled to the housing tube 20 of the swing arm restraint device SRD. In the illustrated embodiment, the enlarged torque transfer head 48 is non-rotatably coupled to the second ear E2 of the swing arm SA1,SA2 but it could alternatively or additionally be non-rotatably coupled to the first ear E1. When the swing arm restraint device SRD is operatively installed, its lock axis LX is coincident and coaxially arranged with respect to the swing axis SX of the corresponding swing arm SA1,SA2. The enlarged torque transfer head 48 can be fastened or otherwise non-rotatably secured to the second ear E2 or other part of the swing arm SA1,SA2 using any suitable connecting device or structure that also allows axial movement of the enlarged torque transfer head 48 in the first and second directions D1,D2 relative to the ear E2 or other part of the swing arm SA1,SA2 as part of the lock shaft LS. In the illustrated embodiment, the torque transfer head 48 is non-circular in terms of its peripheral shape such as the illustrated square or rectangular shape periphery 48*p*, or any other non-circular shape, and the second mounting ear E2 comprises a non-circular lock recess or lock shaft recess 37 (see also FIG. 4) that is correspondingly shaped according to the shape of the torque transfer head 48 or otherwise non-circular and that is dimensioned to non-rotatably receive and surround the lock shaft head 48 when the swing arm SA1,SA2 is installed on the swing arm mount M1,M2 such that the torque transfer head 48 and lock shaft recess 37 are non-rotatably coupled together and such that the torque transfer head 48 is also axially movable into and out of the lock shaft recess 37. When the torque transfer head 48 is non-rotatably positioned in the recess 37, it is non-rotatably connected to the swing arm SA1,SA2 such that pivoting rotation of the swing arm SA1,SA2 about its swing axis SX induces corresponding rotation of the torque transfer head 48, rod 40, and second restraint device RD2 (gear 42) about the lock axis LX and about coincident swing axis SX. The enlarged torque transfer head 48 is able to move axially in the directions D1,D2 in the recess 37 relative to the ear E2 of the swing arm SA1,SA2. As shown herein, the lock shaft recess 37 is defined by a lip or flange 37L that projects upwardly/outwardly from the ear E2. The recess 37 is optionally closed by a removable cover 49 that is fitted on the flange 37L. FIG. 8 shows one of the covers 49 removed (for the swing arm SA2) to reveal the non-rotatable and axially movable mating engagement of the enlarged torque transfer head 48 in the swing arm lock recess 37.

With continuing reference to FIG. 7A, the swing arm restraint device SRD is shown in its locked position or configuration, in which the lock shaft LS is in a first operative (locked) position in which the first and second restraint devices RD1,RD2 are non-rotatably engaged or connected in a locked position (the teeth 34,44 of the respective gears 32,42 are non-rotatably engaged with each other) so that the lock shaft LS and housing 20 are non-rotatably connected and cannot rotate relative to each other. The spring G biases the lock shaft LS in the first direction D1 along the lock axis LX toward and into its locked position. The lock shaft LS is selectively movable in the second direction D2 along the lock axis LX, opposite to the first direction D1, toward and into a second operative (unlocked) position as shown in FIG. 7B to provide an unlocked position or configuration for the swing arm restraint device SRD in which the lock shaft LS and housing 20 are rotatable relative to each other. To obtain this unlocked position of the lock shaft LS and swing arm restraint device SRD, the rod 40 and second restraint device RD2 are moved axially along the lock axis LX (and along the coincident swing axis SX) from the locked position (FIG. 7A) in a second direction D2 that is opposite the first direction D1 to a second operative (unlocked) position (FIG.

7B) in which the second restraint device RD2 is rotatably decoupled from the first restraint device RD1 (i.e., where the teeth 34,44 of the respective gears 32,42 are unmeshed or decoupled) so that the second restraint device RD2 and the swing arm SA1,SA2 non-rotatably connected thereto via rod 40 are able to rotate relative to the first restraint device RD1 so that the swing arm SA1,SA2 is able to pivot or rotate about its swing axis SX relative to the swing arm mounting portion 14 of the frame 10.

The lock shaft LS is movable in the second direction D2 against the biasing force of the spring either via manual force exerted on the rod 40 via knob or other handle portion 46 by a human operator and/or automatically (without application of human force) via contact between the first (lower) end 40*a* of the rod 40 with the floor F when the carriage C1,C2 is moved to its lowered position. The optional cover 49 through which the extension 46*a* of the handle 46 (or rod itself) extends is removably installed over the recess 37 using fasteners 49*f* or a friction fit or other connection, in which case the enlarged torque transfer head 48 includes cut-outs or voids 48*c* that accommodate and provide clearance for the fasteners 49*f* during movement of the lock shaft LS and its enlarged torque transfer head 48 in the first and second directions D1,D2 during locking and unlocking operations as can be seen in FIG. 7B. Alternatively, a hydraulic actuator, a pneumatic actuator, an electric actuator, or other powered actuator can be operably connected to the rod 40 and selectively operate under use control and/or under automated control to selectively move the lock shaft LS in the first and/or second directions D1,D2.

In an alternative embodiment, the operative arrangement of the first (outer) and second (inner) restraint devices RD1,RD2 (gears 32,42) can be exchanged or reversed with respect to each other such that the first/outer gear 32 or other first/outer restraint device RD1 is operably coupled to the swing arm SA1,SA2 to rotate with the swing arm SA1,SA2 about the swing axis SX and such that the second/inner gear 42 or other second/inner restraint device RD2 is operably coupled to the swing arm mounting portion 14 of the carriage frame 10 such that the second/inner gear 42 or other second/inner restraint device RD2 is non-rotatable about the swing axis SX.

Figure 9:
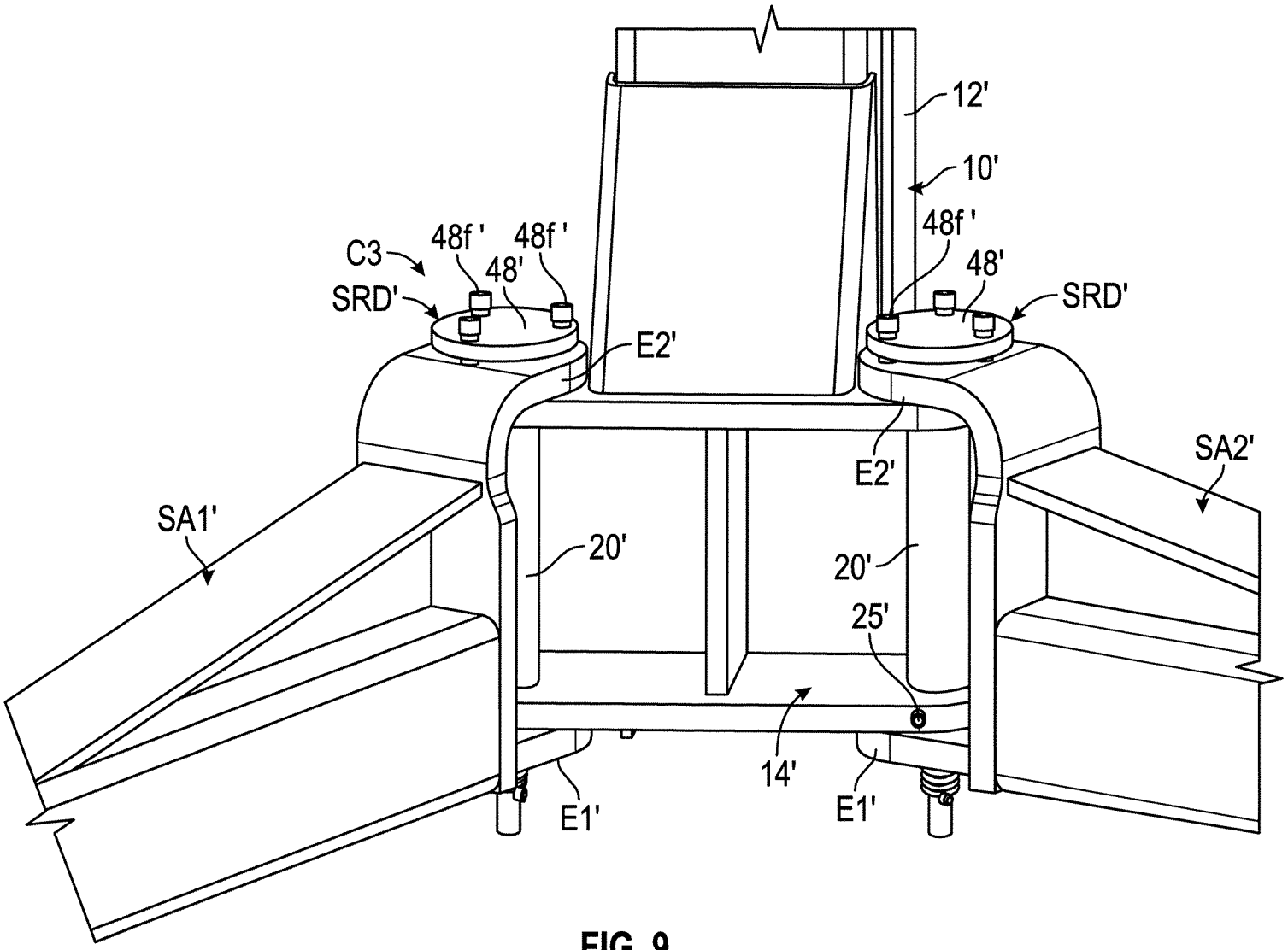
FIG. 9 partially illustrates a carriage including an alternative swing arm restraint device in accordance with an embodiment of the present disclosure.
Figure 10:
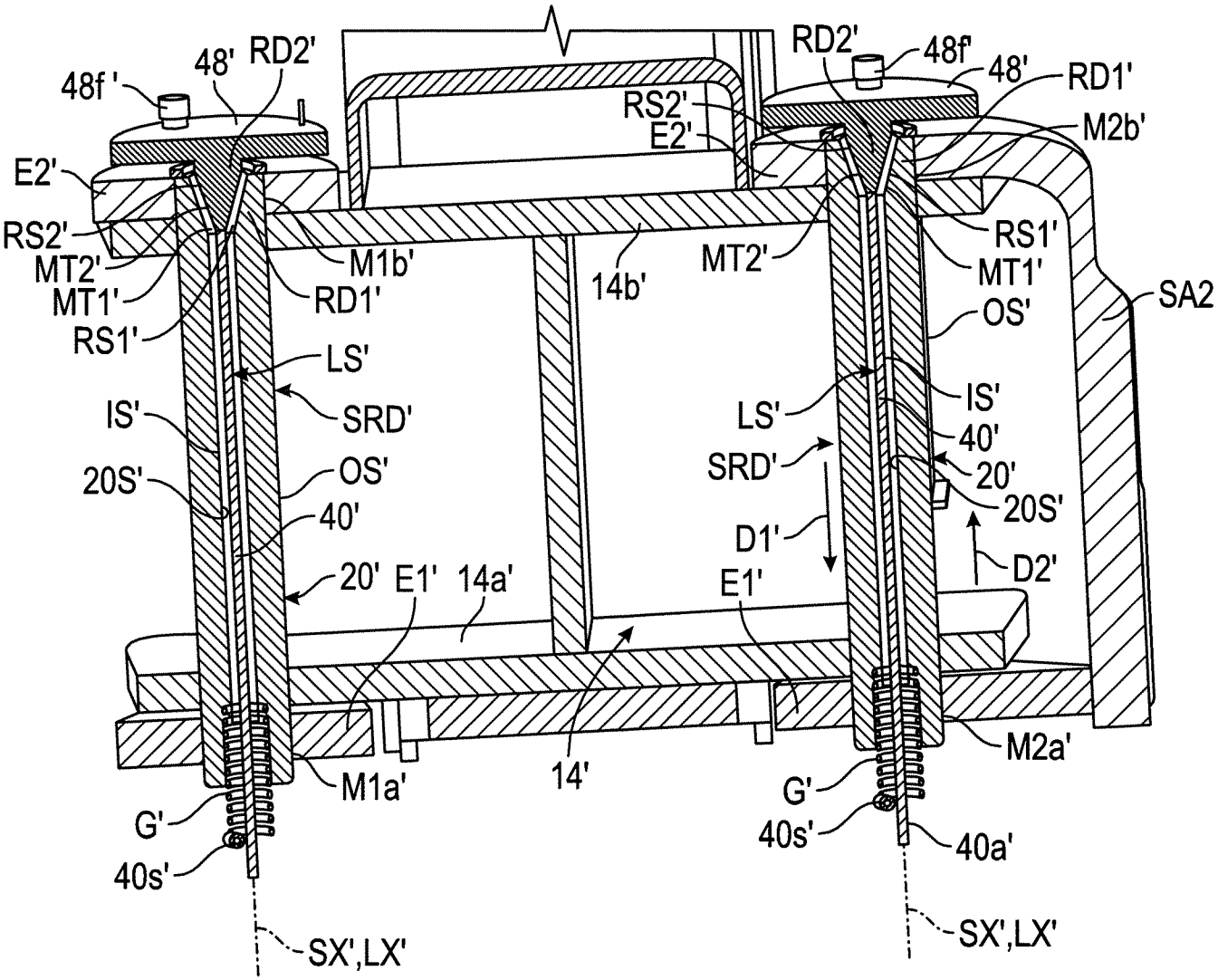
FIG. 10 is a section view of the carriage of FIG. 9.

FIG. 9 partially illustrates a carriage C3 that is identical to the carriages C1,C2 except as otherwise shown and/or described herein. FIG. 10 is a section view of the carriage C3 of FIG. 9. Like or corresponding components of the carriage C3 as compared to the carriage C1,C2 are identified using like reference characters including a primed (') designation, and not all such components are described again. The carriage C3 uses a self-holding or self-locking taper coupling swing arm restraint system or device SRD' for each swing arm SA1,SA2 instead of the gears 32,42. One example of a self-holding or self-locking taper coupling is a Morse taper coupling, but the restraint device SRD' is not intended to be limited to a Morse taper coupling. The housing tube 20' of the swing arm restraint device SRD' is non-rotatably secured to the plates 14*a*',14*b*' of the swing arm mounting portion 14' of the frame 10' in a removable manner and held in this operative position via one or more fasteners such as screws 25' that are engaged with the swing arm mounting portion 14' of the frame 10'. As shown in the section view of FIG. 10, the inner surface IS' of the housing tube 20' that defines the inner bore or inner space 20*s*' includes and/or defines a first restraint device RD1' that comprises a female or first taper member or portion MT1' comprising a smooth, toothless internal conical surface RS1'. The rod 40' of the lock shaft LS' extends through the space 20*s*' of the housing tube 20' and includes and/or defines the second restraint device RD2' that comprises a male or second taper member or portion MT2' including a smooth, toothless external conical surface RS2'. The second (male) taper portion MT2' is configured to non-rotatably engage the first (female) taper portion MT1' when the lock shaft LS' is located in its locked position where the male and female taper portions are abutted and urged into contact with each other via spring G' that biases the male taper portion MT2' in the first direction D1' axially toward and into contact with the female taper portion MT1'.

The female and male taper portions MT1',MT2' are selectively decoupled so as to be rotatable relative to each other by axial movement of the rod 40' relative to the housing 20' in the second direction D2' that is opposite the first direction D1'. The rod 40' includes an enlarged torque transfer head 48' that is non-rotatably coupled to the swing arm SA1',SA2' so as to rotate therewith about the swing axis SX' but the enlarged torque transfer head 48' is also axially moveable in the first and second directions D1,D2 relative to the swing arm SA1',SA2' to allow the taper portions MT1',MT2' to couple and decouple as noted. In the illustrated embodiment, a plurality of shoulder bolt or other fasteners 48*f* are used to non-rotatably secure the enlarged torque transfer head 48' to the second ear E2' or other portion of the swing arm SA1',SA2'. The fasteners 48*f* also allow sufficient axial movement of the enlarged torque transfer head 48' and the rod 40' relative to the ear E2' and relative to the housing tube 20' in the first and second axial directions D1',D2' for selective coupling and decoupling of the taper portions MT1',MT2'. In the illustrated embodiment of the carriage C3, the rod 40' lacks a handle 46 for manual human operator movement of the rod 40' in the second axial direction D2' to unlock the swing arm restraint device SRD', but such a handle 46 is optionally included. Instead, rod 40' is moved in the second direction D2' to its unlocked position where the taper portions MT1',MT2' are decoupled via contact between the protruding first end 40*a*' of the rod 40' and the shop floor F when the carriage C3 is moved to its lowered position on its post P1,P2. When the carriage C3 is raised on its post P1,P2, the spring G' urges the rod 40' in the first direction D1' to its locked position where the taper portions MT1',MT2' are again abutted and non-rotatably coupled together so that the swing arm SA1',SA2' is prevented from pivoting/rotating about the swing axis SX' due to its non-rotatable connection with the rod 40' which is, in turn, non-rotatably coupled to the swing arm mounting portion 14' of the frame 10' via the non-rotatably engaged taper portions MT1',MT2'.

Figure 11:
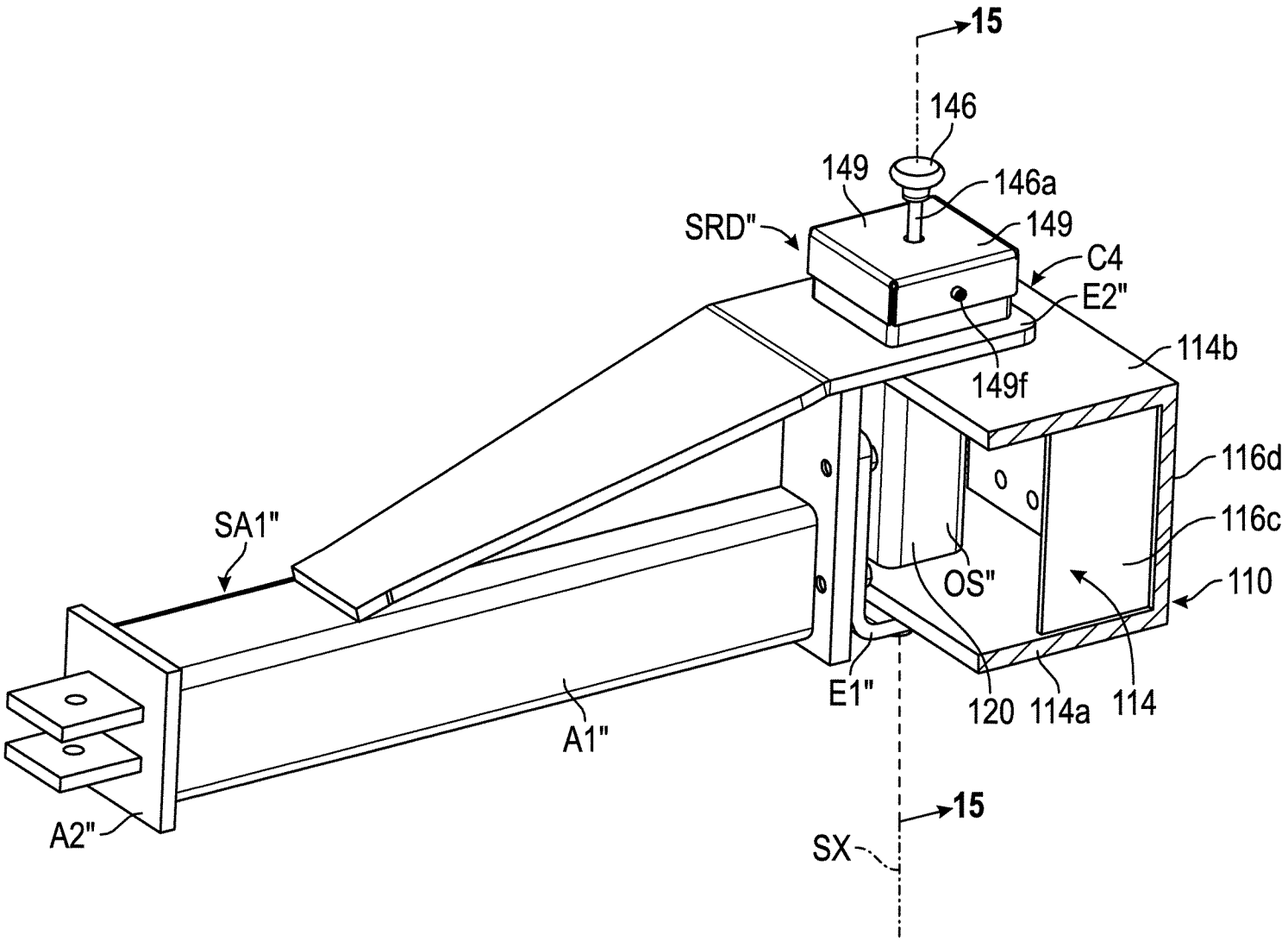
FIG. 11 partially illustrates the swing arm mounting portion of a carriage and swing arm restraint system provided in accordance with an alternative embodiment of the present development.
Figure 12:
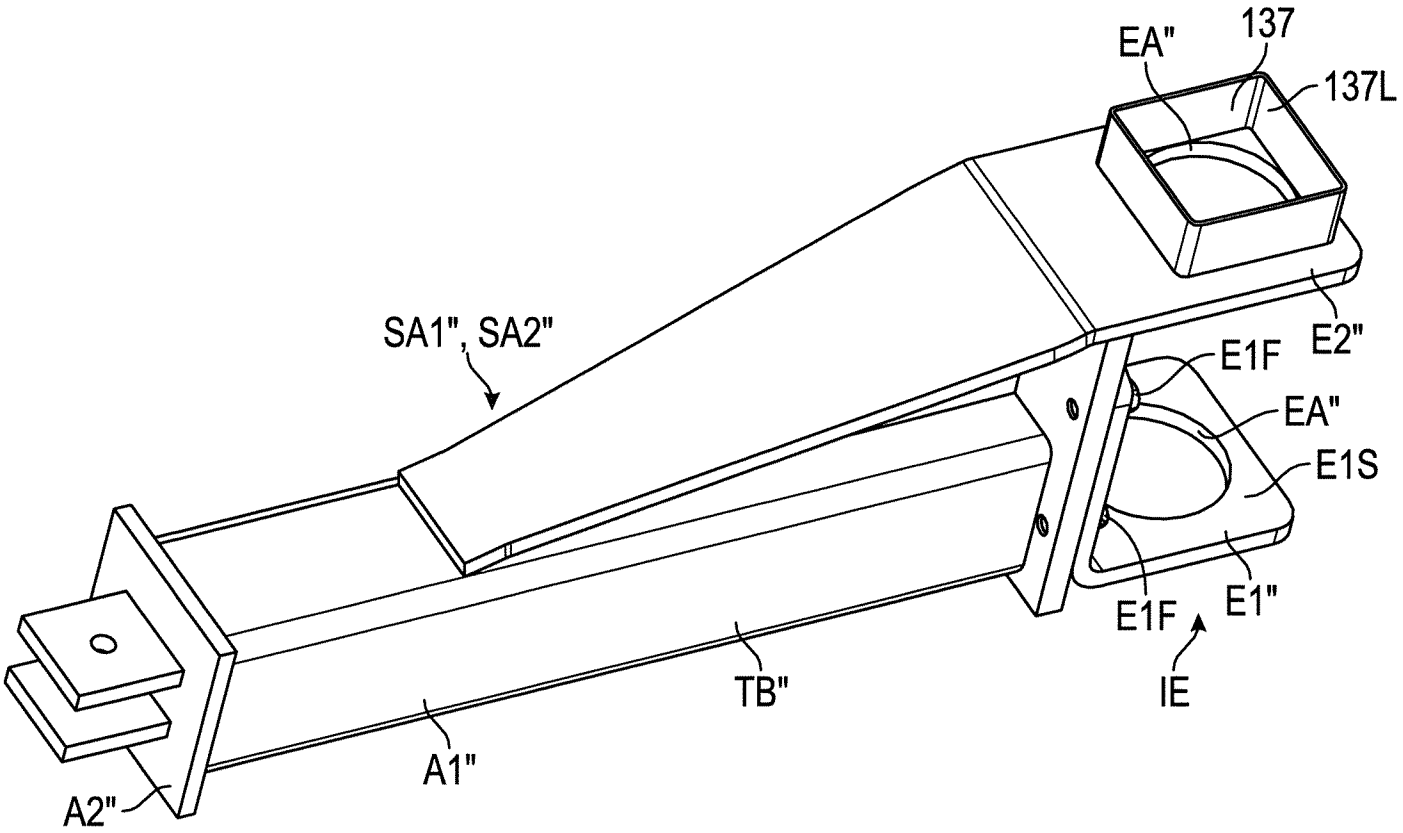
FIG. 12 is an isometric view that shows an alternative embodiment of an inner segment of a swing arm of FIG. 11.

FIG. 11 partially illustrates a carriage C4 that is identical to the carriages C1,C2 described above except as otherwise shown and/or described, and the carriage C4 includes a swing arm restraint system or device SRD" that is identical to the swing arm restraint system or device SRD except as otherwise shown and/or described herein. The carriage C4 is only partially shown such that only a single swing arm restraint device SRD" for the swing arm SA1" is shown, but the carriage C4 includes first and second identical swing arm restraint devices SRD" for operatively restraining respective first and second swing arms SA1,SA2 or SA1",SA2" as described above in relation to the carriages C1,C2. Those of ordinary skill in the art will recognize that the carriage C4 includes first and second swing arm restraint devices SRD" (only one shown in FIG. 11) for respectively pivotally connecting first and second swing arms SA1,SA2 or SA1", SA2" to the carriage C4 and for controlling the angular position of the first and second swing arms SA1,SA2 or SA1",SA2" about their swing axes SX relative to the carriage C4. Like components of the carriage C4 and swing arm restraint device SRD" relative to the carriage C1,C2 and swing arm restraint device SRD are identified with like reference numbers that are 100 greater than those used in relation to the carriage C1,C2 and swing arm restraint device SRD, or are identified with corresponding reference numbers or reference characters that include a double-primed (") designation, in some cases without being described again here except.

In contrast to the cylindrical housing tube 20 of the swing arm restraint device SRD, the swing arm restraint device SRD" of the carriage C4 comprises a housing tube 120 that includes a non-circular cross sectional shape including a non-circular outer surface OS" and a non-circular inner surface IS". Alternatively, one of the outer surface OS" and inner surface IS" can be non-circular while the other of the outer surface OS" and inner surface IS" is circular. The non-circular inner and outer surfaces IS",OS" can be correspondingly shaped or they can be different with respect to each other. In the illustrated embodiment, both the inner and outer surfaces IS",OS" of the housing tube 120 are rectangular such as square as shown herein or otherwise rectangular, but any other non-circular shape(s) can be used. The non-circular outer surface OS" facilitates non-rotational connection of the housing tube 120 to the swing arm mounting portion 114 of the carriage C4 and the non-circular inner surface IS" facilitates non-rotational connection of the first or outer restraint device RD1" in the internal space 120*s* of the housing tube 120.

With reference to FIGS. 12-14B, the swing arm SA1", SA2" (shown by itself in FIG. 12) is substantially identical to the swing arm SA1,SA2 except that the first mounting ear E1" comprises a separate L-shaped ear structure E1S that is bolted or otherwise fastened to the inner segment A1" of the tubular body TB" via multiple removable bolts or other removable fasteners E1F which can facilitate assembly of the swing arm SA1",SA2" itself and can also facilitate connection of the swing arm SA1",SA2" to the swing arm mounting portion 114 of the carriage C4 (or to the swing arm mounting portion 14 of a carriage C1,C2) in that the first mounting ear E1" can be pivotally connected to the first swing arm mount M1*a*" (or first swing arm mount M2*a*") and fixedly secured to the tubular body TB" of the swing arm inner segment A1" after second mounting ear E2" is pivotally engaged with the second swing arm mount M1*b*" (or second swing arm mount M2*b*"). The removable first mounting ear E1" aids in initial assembly of the swing arm SA1",SA2" to the swing arm mounting portion 114 and also facilitates disconnection of the swing arm SA1",SA2" from the swing arm mounting portion 114 of the carriage C4 as required for repair or other disassembly in that the swing arm SA1",SA2" can be easily separated from its mounts M1*a*",M1*b*" by removal of the ear fasteners E1F and the L-shaped ear structure E1S from the inner segment A1". As with the swing arm SA1,SA2, the first and second mounting ears E1",E2" comprise respective circular mounting apertures EA" defined therein that are adapted to be pivotally engaged with the first swing arm mounts M1*a*", M1*b*" or the second swing arm mounts M2*a*" M2*b*".

Figure 13:
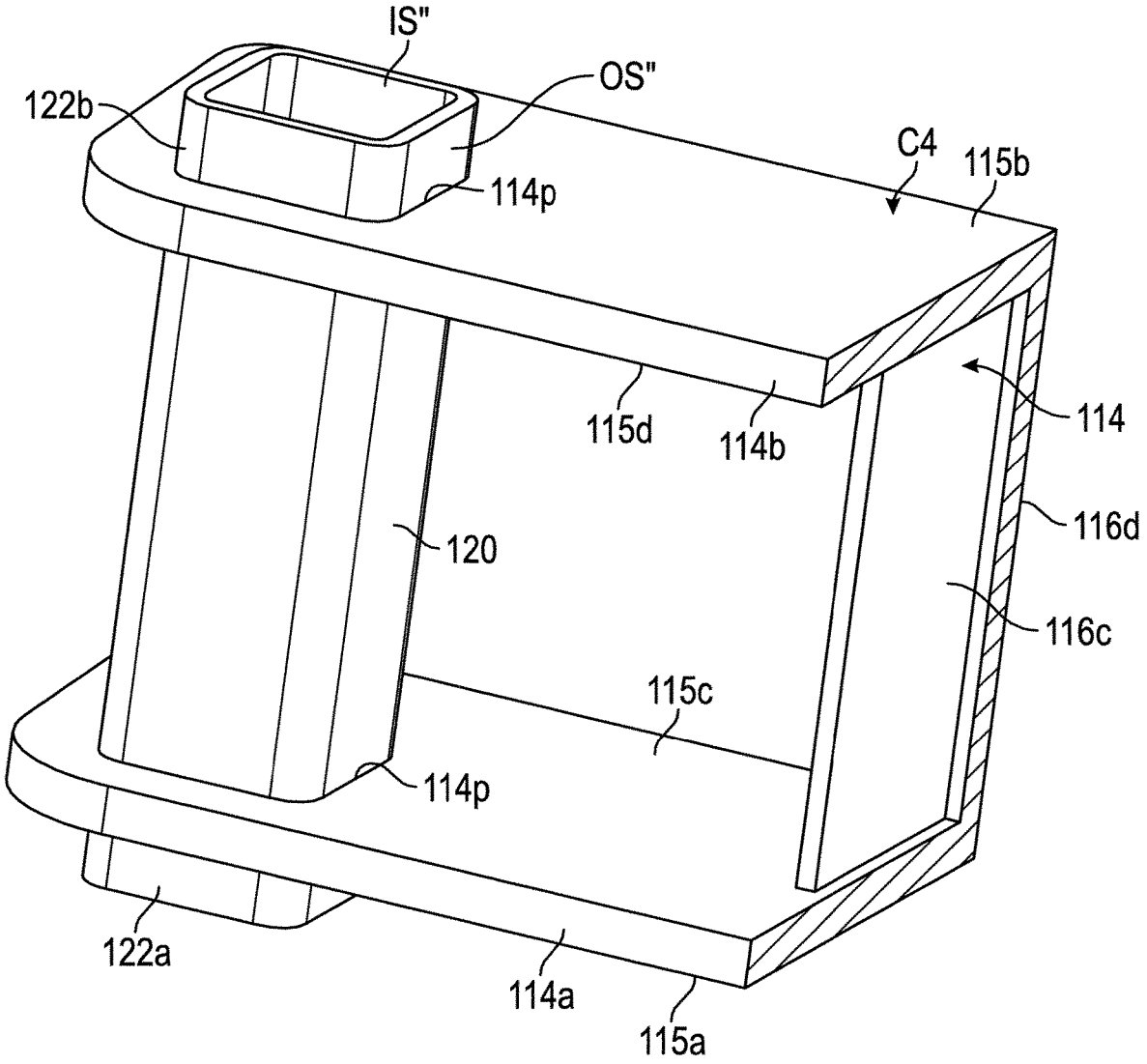
FIG. 13 is a partial view of the swing arm mounting portion and restraint system of FIG. 11 with components removed.
Figure 14A:
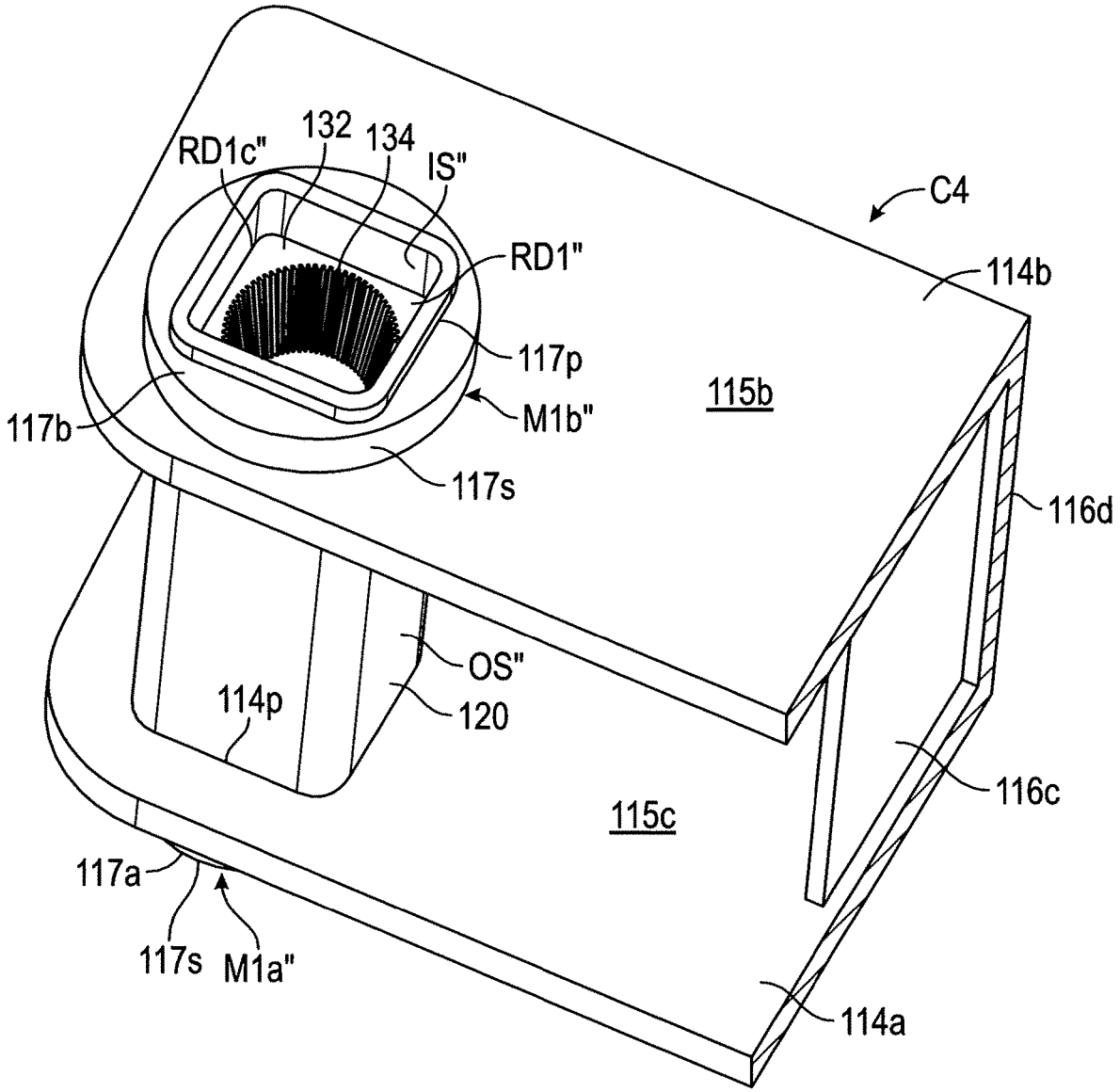
FIGS. 14A & 14B are respective top and bottom isometric views of the swing arm mounting portion and housing tube of FIG. 13.
Figure 14B:
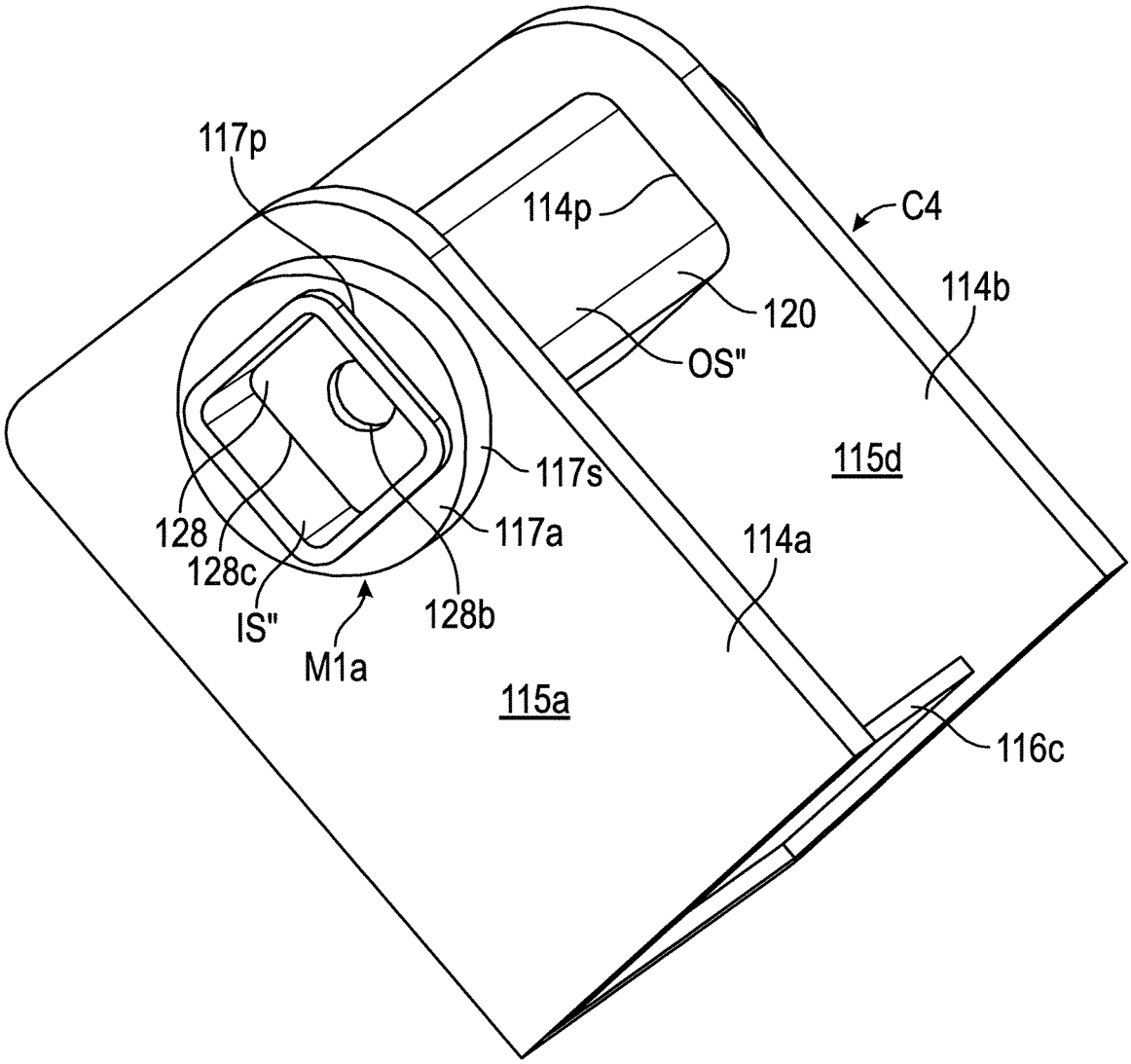
Figure 15:
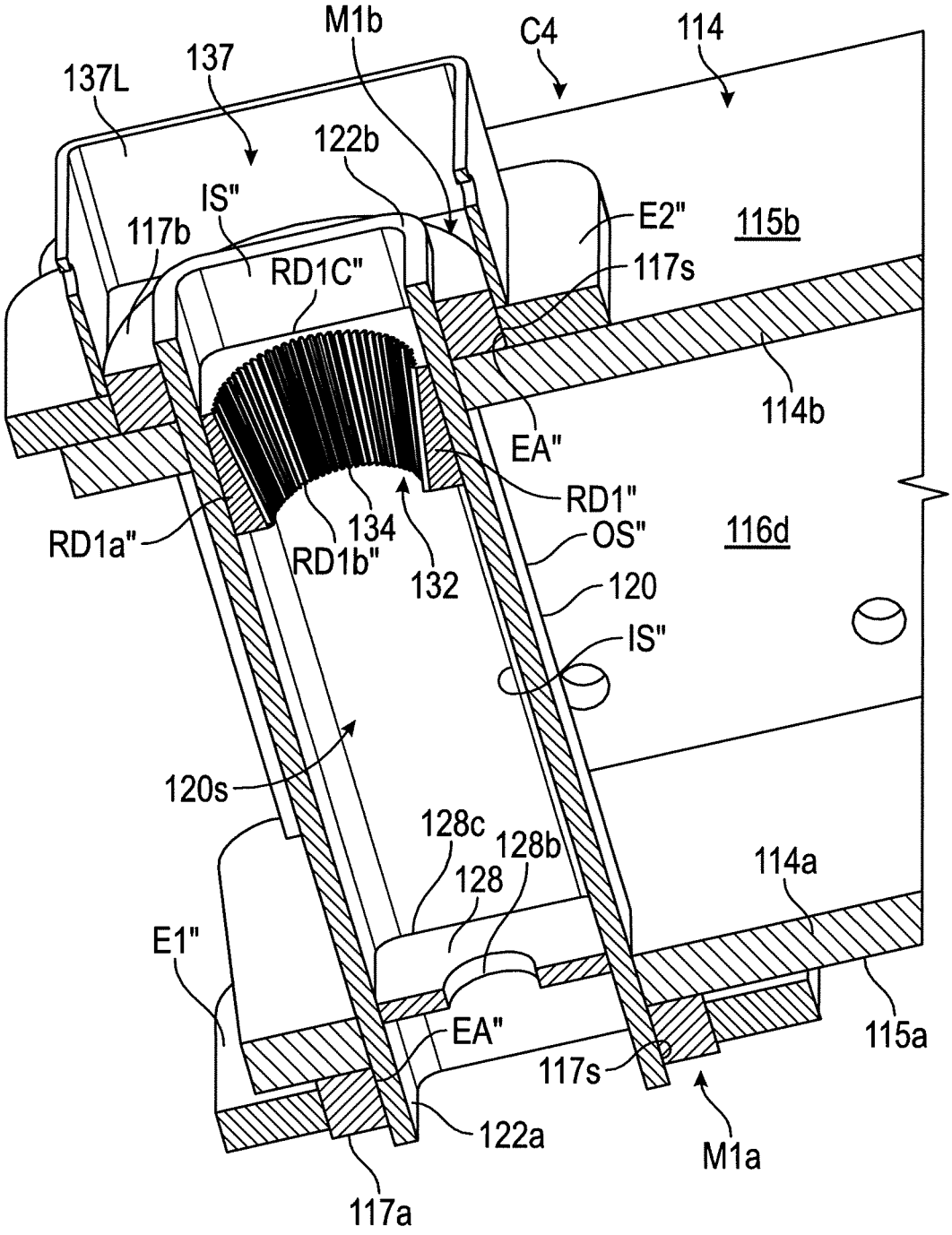
FIG. 15 is a section view as taken at line 15-15 of FIG. 11 with certain components removed for clarity.

As shown in FIGS. 13-14B, the swing arm restraint housing tube 120 is fitted into a pair of aligned non-circular mounting apertures 114*p* that are respectively defined in the mounting plates 114*a*,114*b* of the swing arm mounting portion 114. The mounting apertures 114*p* are shaped and dimensioned to closely match the dimensions and shape of the outer surface OS" of the housing tube 120 such that the housing tube 120 is closely, non-rotatably received in the mounting apertures 114*p* with minimal clearance. The swing arm restraint housing tube 120 can be fixedly secured to the swing arm mounting portion 114 of the frame 110 by welding to the mounting plates 114*a*,114*b* or by use of fasteners or other suitable connection structures.

The housing tube 120 is installed such that the first and second opposite ends 122*a*,122*b* of the tube 120 project respectively outwardly from the first and second plates 114*a*,114*b*. As shown in FIGS. 14A and 14B, a first pivot boss such as the illustrated annular pivot boss 117*a* is non-rotatably mounted on the first end 122*a* of the housing tube 120 adjacent the outer face 115*a* of the first mounting plate 114*a* and a second pivot boss such as the annular pivot boss 117*b* is non-rotatably mounted on the second end 122*b* of the housing tube 120 adjacent the outer face 115*b* of the second mounting plate 114*b*. Each annular pivot boss 117*a*, 117*b* (117) preferably includes a non-circular inner aperture 117*p* that is dimensioned and shaped to be closely non-rotatably received on the non-circular outer surface OS" of the housing tube 120, and the pivot boss 117 is welded, fastened, or otherwise fixedly secured to the adjacent mounting plate 114*a*,114*b* and/or to the housing tube 120. Each annular pivot boss 117*a*,117*b* comprises a circular or cylindrical outer surface 117*s* centered on the swing axis SX such that the outer surfaces 117*s* define the swing arm mounts M1*a*,M1*b* (M1) on which the swing arm ear apertures EA are pivotally received as can be seen in the section views of FIGS. 15 & 16.

With continuing reference to FIGS. 14A-16, the swing arm restraint housing tube 120 further comprises a hollow interior bore or space 120*s* defined by a non-circular surface IS". A first or outer restraint member or device RD1" is non-rotatably connected to the inner surface IS" inside the space 120*s* and comprises a body RD1*a*" with a hollow central opening RD1*b*". In the illustrated embodiment, the first restraint device RD1" comprises a ring gear 132 comprising a plurality of internal teeth 134 that can be beveled as shown such that the central opening RD1*b*" diverges radially outward as the teeth 134 extend toward the second (upper) end 122*b* of the housing 120. A guide wall 128 is also located in and extends across the internal housing space 120*s*, between the first restraint device RD1" and the first (lower) end 122*a* of the housing 120. The guide wall 128 comprises a body 128*a* and a central opening 128*b*.

The first restraint device RD1"/ring gear 132 includes a non-circular periphery or outer surface RD1*c*" that corresponds to the size and non-circular shape of the inner surface 120*s* of the housing tube 120 such that the non-circular periphery RD1*c*" of the first restraint device RD1" fits closely and non-rotatably inside the non-circular space 120*s* of the housing tube 120 whereby the first (outer) restraint device RD1" is non-rotatably engaged with the housing tube 120. The restraint device RD1" is operatively axially secured within the internal space 120*s* of the housing tube 120 by welding and/or by fasteners or other suitable structures. Those of ordinary skill in the art will recognize that the matching non-circular shapes of the inner surface IS" of the housing tube 120 and the outer periphery RD1*c*" of the first (outer) restraint device RD1" (ring gear 132) ensure that the restraint device RD1" cannot rotate relative to the housing 120 and reduces the rotational stress on the weld or other connection between the restraint deice RD1" and the housing tube 120.

Similarly, the guide wall 128 comprises a non-circular periphery 128*c* that corresponds to the non-circular inner surface IS" of the housing tube 120 and that is sized and shaped to fit closely inside the inner space 120*s* of the housing tube. The guide wall 128 is welded and/or secured by fasteners in its operative position spaced axially from the first (outer) restraint device RD1".

As described above for the swing arm restraint device SRD, the swing arm restraint device SRD" further comprises a swing arm lock system including a lock shaft lock shaft LS" (FIG. 16) that can be identical to the lock shaft LS except as otherwise shown and/or described herein. The lock shaft LS" is coaxially installed in and extends through the bore 120*s* of the housing tube 120. The lock shaft LS" comprises an elongated rod 140 that extends axially along a locking axis LX. A second or inner restraint member or device RD2" is non-rotatably secured to the rod 140. The lock shaft LS" is movable in first and second opposite directions D1,D2 in the space 120*s* of the housing tube 120 coaxially along the locking axis LX. The second (inner) restraint device RD2" is conformed and dimensioned to selectively non-rotatably mate with the first (outer) restraint device RD1" when the second restraint device RD2" is coaxially received in the central opening RD1*b*" of the first restraint device RD1" or otherwise mates with the first restraint device RD1" whereby the first and second restraint devices RD1",RD2" are non-rotatably engaged with each other when so mated. In the illustrated embodiment, the second restraint device RD2" comprises a gear 142 with external teeth 144 that are adapted to mesh with and engage the internal teeth 134 of the ring gear 132 of the first restraining device RD1". As noted above, the ring gear 132 of the first restraint device RD1" can be a bevel gear, in which case the gear 142 of the second restraint device RD2" is also a bevel gear formed to mate with the ring gear 132 by axially sliding into the central opening RD1*b*" of the ring gear 132. The teeth 134,144 can alternatively be straight teeth that are not beveled, but the use of bevel gears 132,142 shortens the axial movement required for the inner gear 142 to disengage from the outer gear 132 as compared to gears of similar axial thickness that include straight (non-beveled teeth). In another alternative embodiment, the internal teeth 134 of the outer ring gear 132 and external teeth 144 of the inner gear 142 are eliminated entirely to provide smooth mating tapered surfaces that frictionally engage when abutted whereby the smooth tapered central opening RD1*b*" of the first restraint device RD1" defines the female side of a self-holding (or self-locking) taper coupling (such as a Morse taper coupling or other self-holding taper coupling) and the smooth correspondingly tapered outer surface of the second restraint device RD2" defines the male side of the self-holding taper coupling for non-rotatably connecting the first and second restraint devices RD1",RD2" via friction when the respective inner and outer tapered surfaces of the first and second restraint devices RD1",RD2" are abutted and axially loaded.

The rod 140 comprises a first or lower end 140*a*, and a second or upper end 140*b*. Between its opposite ends 140*a*,140*b* the rod 140 passes through the aperture 128*b* in the guide plate 128 with a small clearance such that the guide plate 128 supports and centers the rod 140 coaxially in the space 120*s* of the housing tube 120. A knob or other handle 146 is defined as part of and/or otherwise operably connected to the second rod end 140*b* and is adapted for manual grasping by a human operator to move the rod 140 axially in a second direction D2 such that the second (upper) end 140*b* of the rod 140 moves away from the first (lower) end 122*a* of the housing tube 120. In the illustrated embodiment, the handle 146 includes an elongated extension 146*a* that is threaded or otherwise secured to the gear 142, and the gear 142 is operably connected to the upper end 140*b* of the rod 140.

The swing arm restraint device SRD" further comprises a spring G" operatively engaged between the rod 140 and the housing tube 120 that continuously biases the rod 140 in the first direction D1 toward the first (lower) end 120*a* of the housing tube 120. In the illustrated embodiment, the spring G" is a coil spring coaxially installed on the rod 140 between the guide plate 128 and the first end 140*a* of the rod 140. A stop 140*s* such as a cross-pin or other radially enlarged structure is connected to and/or formed as part of the rod 140 between the spring G" and the outermost portion of the first rod end 140*a* and captures the spring G" on the rod 140 between the stop 140*s* and the guide plate 128 such that the spring G" resiliently acts between and against both the guide plate 128 and the stop 140*s* to continuously bias the rod 140 in the first direction D1 toward the first end 122*a* of the housing 120.

The lock shaft LS" further comprises an enlarged torque transfer plate or head 148 non-rotatably connected directly or indirectly to the gear 142 or other second (inner) restraint device RD2". In the illustrated embodiment of FIG. 16, the torque transfer head 148 and the gear 142 are defined together as a unitary structure such as from a one-piece metallic construction that is cast, machined, formed of powdered metal, and/or otherwise formed and/or processed. In this embodiment, the rod 140 is shown as being connected to the gear 142 such as by welding or another connection method or structure. Alternatively, as shown in FIG. 17, the gear 142 and torque transfer head 148 are separate metallic structures joined by a non-rotatable mechanical connection 148*c* and axially secured in operative engagement by a fastener 142*f*. In either case, the torque transfer head 148 and gear 142 are non-rotatably coupled or connected as a one-piece or multi-piece structure such that rotation of the torque transfer head 148 about the swing axis SX induces corresponding rotation of the gear 142 (second restraint device RD2") about the swing axis SX (in this embodiment, the rod 140 can be rotatably or non-rotatably connected to the gear 142 (second restraint device RD2").

When the swing arm restraint device SRD" is operatively installed on the carriage C4, the torque transfer head 148 of the swing arm restraint device SRD" is non-rotatably connected or coupled to the swing arm SA1",SA2" that is pivotally connected or coupled to the housing tube 120 of the swing arm restraint device SRD". In the illustrated embodiment, the enlarged torque transfer head 148 is non-rotatably coupled to the second ear E2" of the swing arm SA1",SA2" but it could alternatively or additionally be non-rotatably coupled to the first ear E1". When the swing arm restraint device SRD" is operatively installed, its lock axis LX is coincident and coaxially arranged with respect to the swing axis SX of the corresponding swing arm SA1", SA2". The enlarged torque transfer head 148 can be fastened or otherwise non-rotatably secured to the second ear E2" or other part of the swing arm SA1",SA2" using any suitable connecting device or structure that also allows axial movement of the enlarged torque transfer head 148 in the first and second directions D1,D2 relative to the ear E2" or other part of the swing arm SA1",SA2" as part of the lock shaft LS". In the illustrated embodiment, the torque transfer head 148 is non-circular in terms of its peripheral shape such as the illustrated square or rectangular shape periphery 148*p*, or any other non-circular shape, and the second mounting ear E2" comprises a non-circular lock shaft recess 137 that is correspondingly shaped according to the shape of the torque transfer head 148 or otherwise non-circular and that is dimensioned to non-rotatably receive and surround the lock shaft head 148 when the swing arm SA1",SA2" is installed on the swing arm mount M1 ",M2" such that the torque transfer head 148 and lock shaft recess 137 and second mounting ear E2" are non-rotatably coupled together and such that the torque transfer head 148 is also axially movable in the lock shaft recess 137. When the torque transfer head 148 is non-rotatably positioned in the recess 137, it is non-rotatably connected to the swing arm SA1",SA2" such that pivoting rotation of the swing arm SA1",SA2" about its swing axis SX induces corresponding rotation of the torque transfer head 148 and gear 142 as a unit about the lock axis LX and about the coincident swing axis SX. The enlarged torque transfer head 148 is able to move axially in the directions D1,D2 in the swing arm recess 137 relative to the ear E2" of the swing arm SA1",SA2". As shown herein, the lock shaft recess 137 is defined by a lip or flange 137L that projects upwardly/outwardly from the ear E2". The recess 137 is optionally closed by a removable cover 149 that is fitted on the flange 137L as described above in relation to the recess 37 and cover 49.

Figure 16:
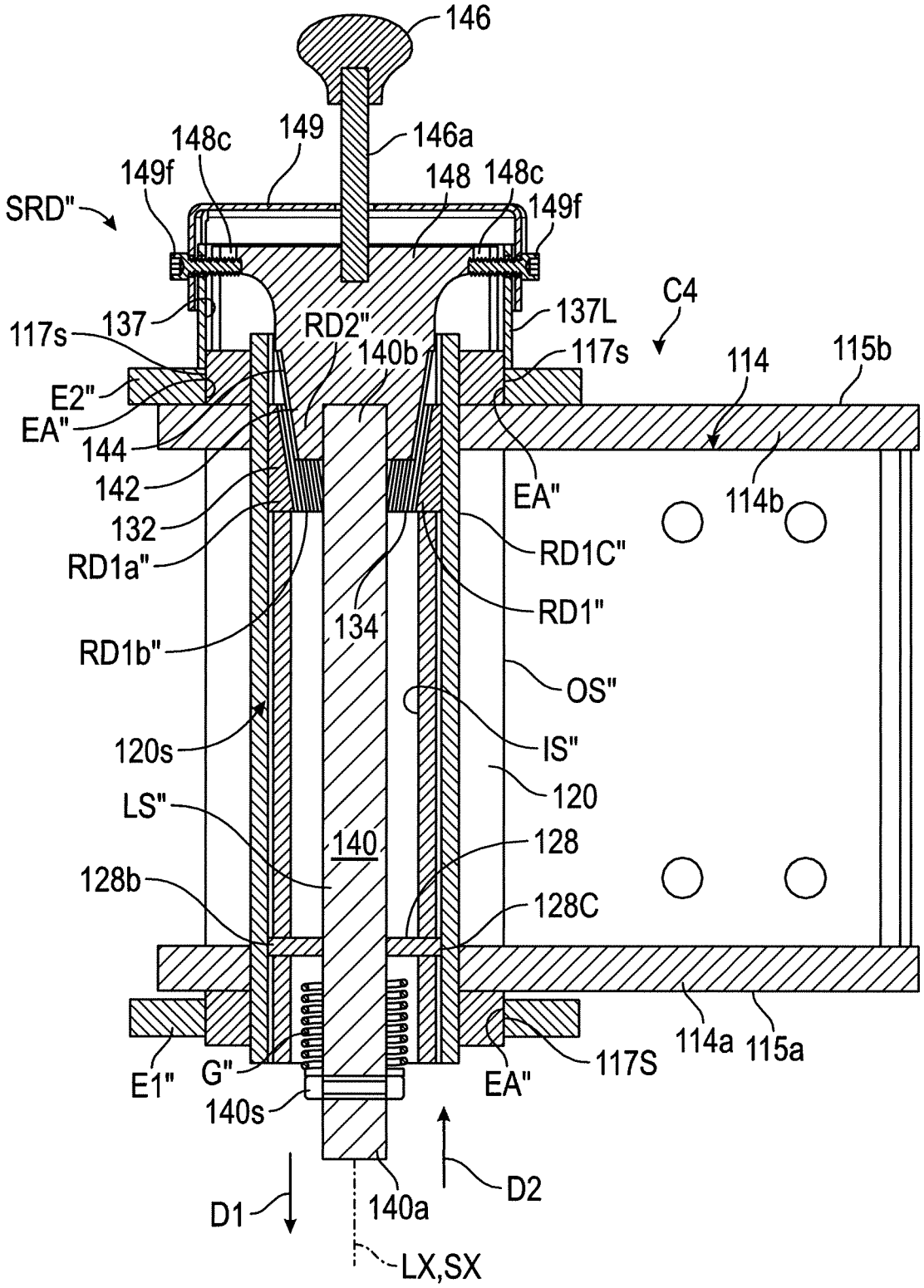
FIG. 16 is similar to FIG. 15 but also shows the lock shaft and related components operably installed as part of the swing arm restraint device.
Figure 17:
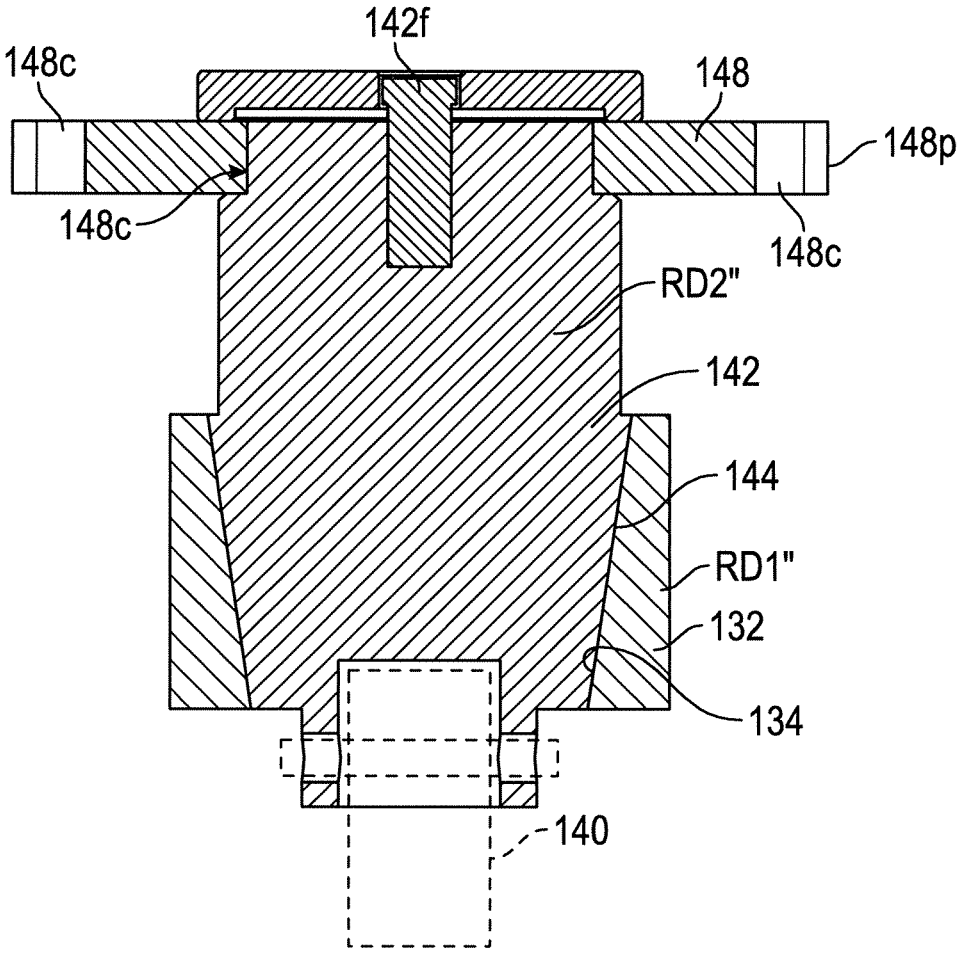
FIG. 17 is a section view that illustrates one example of a subassembly of the lock shaft of FIG. 16.

With reference to FIG. 16, the swing arm restraint device SRD" is shown in its unlocked configuration, in which the lock shaft LS" is in a second operative (unlocked) position in which the first and second restraint devices RD1",RD2" (gears 142,132) are decoupled so as to be rotatable relative to each other about the lock axis LX/swing axis SX. The spring G" biases the lock shaft LS" in the first direction D1" along the lock axis LX" toward and into its locked position where the first and second restraint devices RD1",RD2" (gears 142,132) are non-rotatably coupled to each other. As noted above, the lock shaft LS" is selectively movable against the biasing force of the spring G" in the second direction D2 along the lock axis LX, opposite to the first direction D1, toward and into the illustrated second operative (unlocked) position to provide the unlocked configuration for the swing arm restraint device SRD" in which the lock shaft LS and housing 120 are rotatable relative to each other. To obtain this unlocked position of the lock shaft LS" and swing arm restraint device SRD", the rod 140 and second restraint device RD2" (gear 142) are moved axially along the lock axis LX (and along the coincident swing axis SX) from the locked position in the second direction D2 that is opposite the first direction D1 to the second operative (unlocked) position in which the second restraint device RD2" is rotatably decoupled from the first restraint device RD1 (i.e., where the teeth 134,144 of the respective gears 132,142 are unmeshed or decoupled) so that the second restraint device RD2" and the swing arm SA1",SA2" non-rotatably connected thereto via rod torque transfer head 148 are able to rotate relative to the first restraint device RD1" so that the swing arm SA1",SA2" is able to pivot or rotate about its swing axis SX relative to the swing arm mounting portion 114 of the frame 110.

The lock shaft LS" is movable in the second direction D2 against the biasing force of the spring G" either via manual force exerted on the rod 140 via knob 146 or other handle portion by a human operator and/or automatically (without application of human force) via contact between the first (lower) end 140*a* of the rod 140 with the floor F when the carriage C4 is moved to its lowered position. The optional cover 149 through which the extension 146*a* of the handle 146 (or rod 140 itself) extends is removably installed over the recess 137 using fasteners 149*f* or a friction fit or other connection, in which case the enlarged torque transfer head 148 includes cut-outs or voids 148*c* that accommodate and provide clearance for the fasteners 149*f* during movement of the lock shaft LS" and its enlarged torque transfer head 148 in the first and second directions D1,D2 during locking and unlocking operations.

Figure 18:
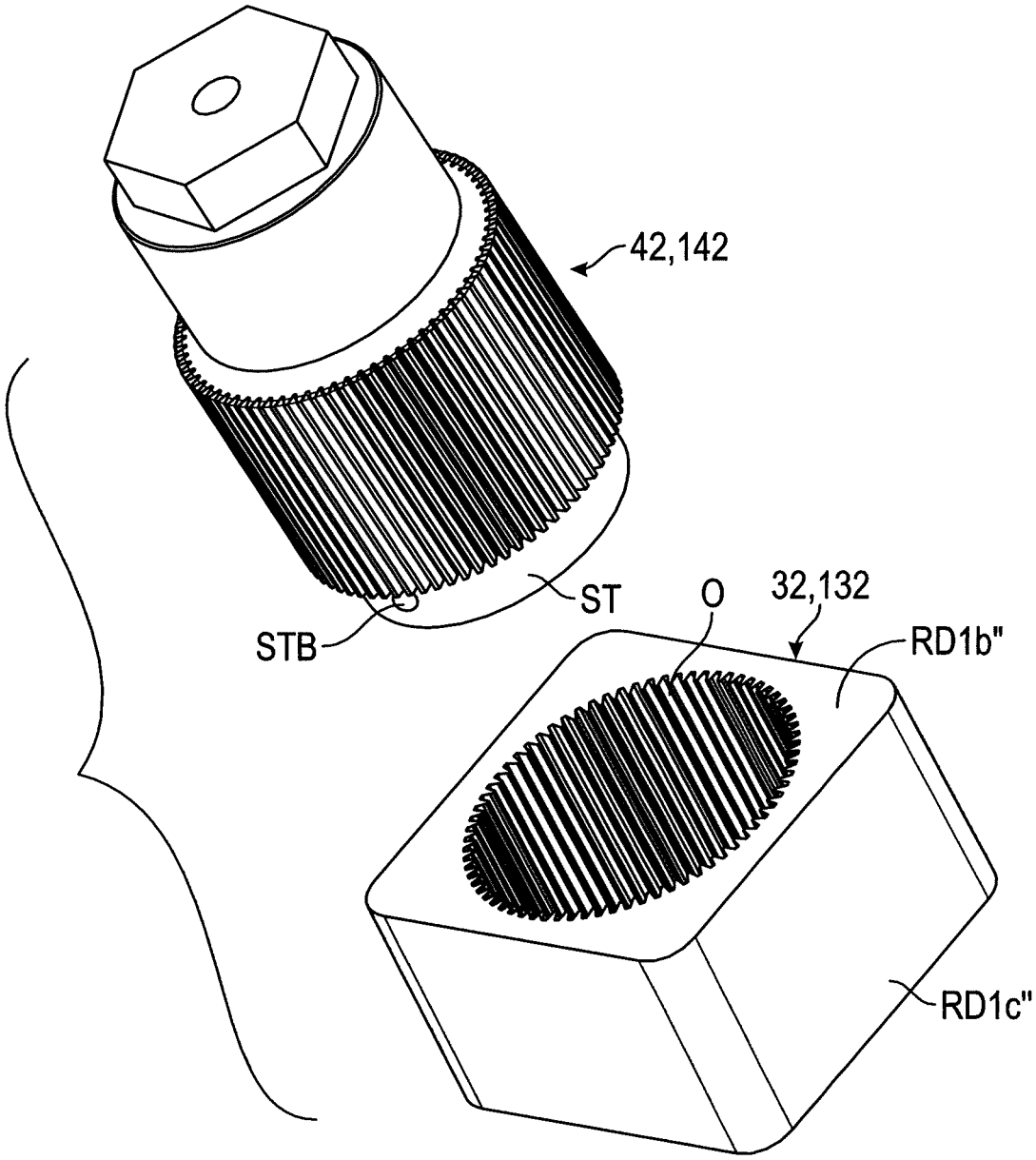
FIG. 18 is an exploded isometric view that illustrates an alternative embodiment of the first (outer) and second (inner) restraint devices comprising respective straight gears.
Figure 19:
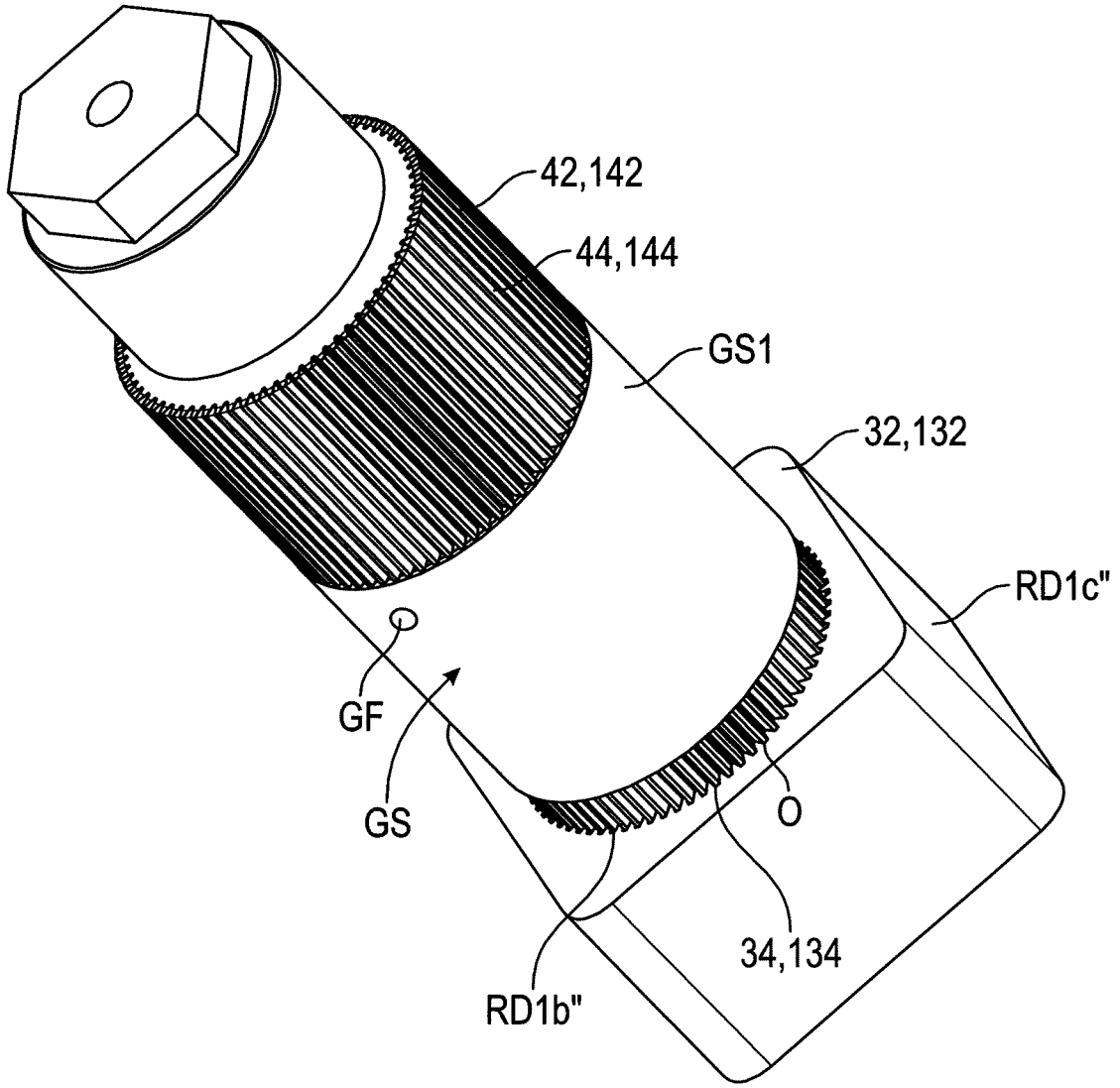
FIG. 19 is similar to FIG. 18 but further illustrates a guide device provided in accordance with an embodiment of the present disclosure.

FIG. 18 is an exploded view that shows an embodiment of the second/inner restraint device RD2, RD2" (second or inner gear 42,142) with straight (non-beveled) gear teeth 44,144 disengaged from the first/outer restraint device RD1, RD1" (first or outer gear 32,132) also formed with straight (non-beveled) gear teeth 34,134. When the gears 32,42 or 132,142 are closely matched to engage with minimal clearance or backlash, it can be difficult to axially mesh the gears by axially insertion of the inner gear 32,132 into the central opening O (RD1*b*") defined between the tips of the outer gear teeth 34,134. To overcome this problem, as shown in FIG. 19, a guide sleeve GS is connected to and/or formed as part of the inner gear 42,142 and projects axially outward toward the outer ring gear 32,132. In the illustrated example, the guide sleeve GS is pinned or otherwise connected to a mounting stud ST that projects axially outward from the inner gear 32,132. In one example as shown herein, the stud ST includes at least one cross-bore STb for receiving a pin or other fastener(s) GF for affixing the guide sleeve GS to the gear 32,132. In one example, the guide sleeve GS comprises a cylindrical outer surface GS1 that is dimensioned to fit within the central opening O such that the guide sleeve centers the inner gear 42,142 relative to the outer gear 32,132 to facilitate axial engagement. Alternatively, the guide sleeve can be tapered and/or include a tapered region having a minimum diameter spaced from the gear 42,142 much smaller than the diameter of the opening O and a maximum diameter located adjacent the gear 42,142 that is only minimally smaller than the diameter of the opening O to facilitate insertion of the guide sleeve GS into the gear opening O.

In an alternative embodiment, the operative arrangement of the first (outer) and second (inner) restraint devices RD1",RD2" (gears 132,142) can be exchanged or reversed with respect to each other such that the first/outer gear 132 or other first/outer restraint device RD1" is operably coupled to the swing arm SA1",SA2" to rotate with the swing arm SA1",SA2" about the swing axis SX and such that the second/inner gear 142 or other second/inner restraint device RD2" is operably coupled to the swing arm mounting portion 114 of the carriage frame 110 such that the second/inner gear 142 or other second/inner restraint device RD2" is non-rotatable about the swing axis SX.

A swing arm restraint device SRD,SRD',SRD" and lift L including same provided in accordance with the present development provides a more compact device as compared to prior designs owing to the fact that the restraint devices RD1,RD2 or RD1',RD2' or RD1",RD2" are located in the housing tube 20,20',120 between the swing arm ears E1,E2 or E1',E2' or E1",E2". The area vertically above the ear E2,E2',E2" is less obstructed as compared to prior designs. Furthermore, prior designs utilize mating gear segments that are arranged on offset parallel axes relative to each other which can lead to misalignment and potential failure under load. In contrast, the swing arm restraint device SRD,SRD', SRD" described herein uses gears 32,42/132,142 arranged coaxially so that the mating gears 32,42/132,142 are not disturbed or affected relative to each other by vertical loads on the swing arms SA1,SA2 or SA1"SA2". Such vertical loads are supported by the housing tube 20,20',120 and transmitted to the swing arm mounting portion 14,14',114 of the frame 110 without being unevenly exerted on the restraint devices RD1,RD2 or RD1',RD2' or RD1",RD2".

Another important operational advantage of a swing arm restraint device SRD, SRD', SRD" and lift L according to the present disclosure is that the amount of angular movement at the distal end of a long (e.g., 60 inch) swing arm SA1,SA2 or SA1",SA2" is quite small per tooth adjustment position as compared to known designs due to the smaller size/finer pitch of the gear teeth 34,44/134,144. In one example, the mating teeth 34,44/134,144 are spaced on only a 3-degree pitch which allows for a fine swing arm adjustment for each tooth position. This produces an arc length of only about 3 inches per position of tooth adjustment at the distal end of the swing arm SA1,SA2 or SA1",SA2" which is reasonable for placing the lift pad/adapter PD under the proper vehicle lifting point. Larger tooth sizes for the gear teeth 34,44/134, 144 would cause this arc length distance to become too large so that the location of the lift pad/adapter PD could not be finely controlled.

A further advantage of a swing arm restraint device SRD, SRD',SRD" and lift L according to the present disclosure relates to the fact that the locking gear arrangement 32,42/132,142 of the restraint devices RD1,RD2/RD1", RD2" does not produce undesired eccentricities such as are produced by known offset gear and pawl arrangements. Known gear/pawl arrangements result in generation of large eccentric forces that tend to urge the mating teeth elements apart from each other due to inflections induced by the large eccentric forces. The elimination of eccentric forces in the present design due to the coaxial arrangement of the restraint devices RD1, RD2/RD1", RD2" (e.g., gears 32,42/132, 142) allows for smaller, finer pitch teeth 34,44/134,144 to be utilized in the present design since the eccentric forces that act to urge the teeth apart from each other into a disengaged position are eliminated. The use of smaller, finer pitch teeth of the present design leads to a finer angular adjustment advantage of the swing arm SA1,SA2 or SA1",SA2" as noted above.

It will be recognized that numerous different features and/or components are presented in the embodiments shown and described herein, and that no one embodiment may be specifically shown and described as including all such features and components. As such, it is to be understood that the subject matter of the present disclosure is intended to encompass any and all combinations of the different features and components that are shown and described herein, and, without limitation, that any suitable arrangement of features and components, in any combination, can be used. Thus, it is to be distinctly understood claims directed to any such combination of features and/or components, whether or not specifically embodied herein, are intended to find support in the present disclosure. Thus, while the subject matter of the present disclosure has been described with reference to the foregoing embodiments and considerable emphasis has been placed herein on the structures and structural interrelationships between the component parts of the embodiments disclosed, it will be appreciated that other embodiments can be made and that many changes can be made in the embodiments illustrated and described without departing from the principles hereof. Obviously, modifications and alterations will occur to others upon reading and understanding the preceding detailed description. Accordingly, it is to be distinctly understood that the foregoing descriptive matter is to be interpreted merely as illustrative of the subject matter of the present disclosure and not as a limitation. As such, it is intended that the subject matter of the present disclosure be construed as including all such modifications and alterations.

The invention claimed is:

1. A swing arm restraint system for an automotive lift, said swing arm restraint system comprising:

a movable carriage including a swing arm mounting portion comprising first and second spaced-apart mounting plates;

a tubular swing arm restraint housing non-rotatably connected to the swing arm mounting portion of the carriage, said swing arm restraint housing comprising an internal space;

a swing arm pivotally connected to the swing arm mounting portion and rotatable relative to the swing arm restraint housing about a swing axis, said swing arm comprising a non-circular lock recess;

a first restraint device located in said internal space of and non-rotatably connected to said swing arm restraint housing;

a second restraint device located in said internal space of the swing arm restraint housing and non-rotatably connected to said swing arm, said second restraint device movable in said internal space relative to said first restraint device axially along a lock axis that is coincident with said swing axis between a locked position where said second restraint device is non-rotatably engaged with the first restraint device and an unlocked position where said second restraint device is disengaged from and rotatable relative to the first restraint device;

a rod connected to said second restraint device and extending in said internal space along said lock axis;

a non-circular torque transfer head non-rotatably connected to said second restraint device and non-rotatably engaged with said non-circular lock recess of said swing arm such that said second restraint device is non-rotatably engaged with and rotates with said swing arm, wherein said torque transfer head is axially movable along said lock axis in said recess when said second restraint device moves between said locked and unlocked positions;

a handle operably connected to said second restraint device for manually moving said second restraint device along said lock axis relative to said first restraint device from said locked position toward said unlocked position;

a spring that biases said second restraint device toward said locked position;

wherein: (i) in said locked position, the first and second restraint devices are non-rotatably coupled such that said swing arm and said second restraint device are non-rotatably coupled to said swing arm restraint housing; (ii) in said unlocked position, the first and second restraint devices are decoupled with respect to each other such that said swing arm and said second restraint device are rotatable relative to said swing arm restraint housing;

said swing arm restraint housing comprising a non-circular outer surface and opposite non-circular first and second ends, and said first and second mounting plates respectively comprising first and second non-circular apertures in which said non-circular first and second ends are respectively received such that said swing arm restraint housing extends between and is non-rotatably connected to said first and second mounting plates;

first and second pivot bosses non-rotatably mounted respectively on the non-circular first and second ends of the swing arm restraint housing, said first and second pivot bosses each comprising a cylindrical outer surface, wherein a first ear of said swing arm is pivotally engaged with the cylindrical outer surface of the first pivot boss and a second ear of said swing arm pivotally engaged with the cylindrical outer surface of the second pivot boss for rotation of the swing arm relative to the swing arm mounting portion and relative to the swing arm restraint housing.

2. The swing arm restraint system as set forth in claim 1, wherein said first restraint device comprises a non-circular periphery and said first swing arm restraint housing comprises an inner surface that defines said first internal space to have a non-circular cross-section, and wherein said non-circular periphery of said first restraint device is engaged with said inner surface of said first swing arm restraint housing such that said first restraint device is non-rotatable relative to said first swing arm restraint housing.

3. The swing arm restraint system as set forth in claim 1, wherein said first restraint device comprises a first gear including an opening with internal gear teeth and said second restraint device comprises a second gear including an outer surface with external teeth, wherein said external teeth of said second gear engage said internal teeth of said first gear in said locked position.

4. The swing arm restraint system as set forth in claim 3, wherein said internal gear teeth and said external gear teeth are beveled gear teeth.

5. The swing arm restraint system as set forth in claim 1, wherein said first restraint device comprises a first portion of a self-holding taper coupling and said second restraint device comprises a second portion of a self-holding taper coupling, wherein said first and second taper coupling portions are frictionally non-rotatably engaged in said locked position.

6. A swing arm restraint system for an automotive lift, said swing arm restraint system comprising:

a movable carriage including a swing arm mounting portion comprising first and second spaced-apart mounting plates;

a swing arm restraint housing non-rotatably connected to the swing arm mounting portion, said swing arm restraint housing extending between said first and second mounting plates and comprising first and second opposite ends;

a swing arm pivotally connected to the swing arm mounting portion and rotatable relative to said swing arm restraint housing about a swing axis, said swing arm comprising first and second ears that pivot relative to the first and second mounting plates about the opposite first and second ends of the swing arm restraint housing, respectively;

a non-circular lock recess connected to the second ear of the swing arm such that said lock recess rotates with the second ear, said lock recess defined by a lip that projects outwardly from the second ear;

a first restraint device located in said internal space of said swing arm restraint housing and non-rotatably connected to said swing arm restraint housing;

a second restraint device located in said internal space of said swing arm restraint housing and non-rotatably connected to said swing arm such that said second restraint device rotates with said swing arm relative to said swing arm restraint housing, wherein said second restraint device is non-rotatably connected to said swing arm by: (i) a rod connected to said second restraint device that extends in said internal space along a lock axis that is coincident with said swing axis, said rod comprising a first end that projects outwardly from and that is located external to said swing arm restraint housing and that projects outwardly with respect to said swing arm mounting portion of said movable carriage; (ii) a non-circular torque transfer head connected to said rod, wherein said torque transfer head is located in said lock recess of the swing arm such that said torque transfer head, said rod, and said second restraint device are non-rotatably coupled to said first swing arm, said torque transfer head movable axially along said lock axis in said lock recess;

a handle operably connected to said first end of said rod for manual movement of said rod, said torque transfer head, and said second restraint device relative to said first restraint device along said lock axis from a locked position toward an unlocked position, wherein said torque transfer head is located on said rod between said handle and said second restraint device;

a spring that biases said second restraint device toward said locked position;

said first and second restraint devices configured to be selectively arranged in either one of:

(i) said locked position where the first and second restraint devices are non-rotatably coupled such that said swing arm and said second restraint device are non-rotatably coupled to said swing arm restraint housing;

(ii) an unlocked position where the first and second restraint devices are decoupled with respect to each other such that said swing arm and said second restraint device are rotatable relative to said swing arm restraint housing.

7. The swing arm restraint system as set forth in claim 6, wherein said torque transfer head and said rod are defined together as part of a one-piece structure.

8. The swing arm restraint system as set forth in claim 6, wherein said torque transfer head and said rod are separate components that are non-rotatably connected together.

* * * * *